US005950062A

United States Patent [19]

Yahata et al.

[11] Patent Number: 5,950,062

[45] Date of Patent: Sep. 7, 1999

[54] TONER SORTING DEVICE FOR SEPARATING REUSABLE TONER FROM USED TONER AND IMAGE FORMING APPARATUS USING THE SAME DEVICE

[75] Inventors: Masasumi Yahata; Shunji Katoh; Yuji Kitajima, all of Kanagawa-ken; Satoshi Takano; Shin-ichi Kawahara, both of Tokyo; Fumihito Itoh; Tsutomu Katoh, both of Kanagawa-ken, all of Japan

[73] Assignee: Ricoh Co., Ltd., Tokyo, Japan

[21] Appl. No.: 09/007,099

[22] Filed: Jan. 14, 1998

[30] Foreign Application Priority Data

| | | | |
|---|---|---|---|
| Jan. 14, 1997 | [JP] | Japan | 9-004643 |
| Apr. 17, 1997 | [JP] | Japan | 9-100458 |
| Apr. 18, 1997 | [JP] | Japan | 9-101984 |

[51] Int. Cl.[6] ..... G03G 21/10

[52] U.S. Cl. ..... 399/358; 399/99

[58] Field of Search ..... 399/99, 101, 253, 399/358, 359, 360

[56] References Cited

U.S. PATENT DOCUMENTS

| | | | |
|---|---|---|---|
| 4,319,832 | 3/1982 | Sakamoto et al. | 399/358 X |
| 4,389,968 | 6/1983 | Satomura | 399/359 |
| 5,250,997 | 10/1993 | Kaneko et al. | 399/99 |
| 5,455,666 | 10/1995 | Saito et al. | 399/359 |
| 5,512,994 | 4/1996 | Koike | 399/358 |
| 5,555,469 | 9/1996 | Ishikawa et al. | 399/359 X |
| 5,628,406 | 5/1997 | Yoshida et al. | 399/358 X |
| 5,710,960 | 1/1998 | Hart et al. | 399/253 |
| 5,734,957 | 3/1998 | Ogawa et al. | 399/359 |

OTHER PUBLICATIONS

Patent Abstracts of Japan, JP 8–185101, Jul. 16, 1996.
Patent Abstracts of Japan, JP 8–114948, May 07, 1996.

*Primary Examiner*—Sandra Brase
*Attorney, Agent, or Firm*—Oblon,Spivak, McClelland, Maier & Neustadt, P.C

[57] ABSTRACT

A toner sorting device includes a device for taking in used toner conveyed from an image forming apparatus and conveying the used toner in one direction, and a device for sifting the used toner conveyed from the intake device to separate reusable toner from the used toner. The sifting device includes a tubular sieve for separating reusable toner from the used toner and a device for holding the sieve so that the sieve is rotatable. The sieve has an opening for receiving the used toner conveyed from the intake device to be moved into the sifting device and an opening for discharging the remaining toner separated from the reusable toner and remaining inside the sifting device. The toner sorting device further includes a device for collecting the reusable toner separated from the used toner by the sifting device and a device for collecting the remaining toner discharged from the sifting device. The toner sorting device further includes a device for accelerating sifting of the used toner by the sifting device.

66 Claims, 20 Drawing Sheets

TONER SORTING DEVICE FOR SEPARATING REUSABLE TONER FROM USED TONER AND IMAGE FORMING APPARATUS USING THE SAME DEVICE

BACKGROUND OF THE INVENTION

1. Field of the Invention

The present invention relates to a toner sorting device for separating reusable toner from used toner collected by an image forming apparatus employing electrophotography, such as copiers, facsimiles, printers, etc., and more particularly relates to a toner sorting device which efficiently separates reusable toner from used toner for recycling the reusable toner. The present invention also relates to an image forming apparatus that uses such a toner sorting device.

2. Discussion of the Background

When an image forming apparatus employing electrophotography forms an image, the apparatus first forms an electrostatic latent image of an original document on an image carrier, such as a photoconductor, which is uniformly charged, through exposure of the original or optical writing of information of the original. The latent image is then developed by a developing unit to a visible toner image with developer, such as two-component developer including toner and carrier or single component developer in which toner and carrier are integrated. The toner image is then transferred to a recording sheet by a transfer device, such as a transfer roller or belt, to form a duplicate of the original on the recording sheet. The toner image may alternatively be transferred to an intermediate transfer member, such as an intermediate transfer belt, for superimposing another toner image thereupon to form, for example, a full-color toner image, which is subsequently transferred to a recording sheet. The recording sheet carrying the toner image is then conveyed to a fixing unit by a conveying device, such as a conveying belt. The toner image is then fixed to the recording sheet by the fixing device.

The image forming apparatus further includes cleaning devices for removing residual used toner remaining on the photoconductor or the intermediate transfer member for preventing contamination of subsequent images to be formed thereupon. The image forming apparatus also includes cleaning devices for removing used toner remaining on the transfer belt and the conveying belt. The used toner collected by these cleaning devices is typically conveyed to and moved into a discardable toner bottle, i.e. a toner bottle for storing discardable toner, and is disposed of by a service person or a user of the apparatus.

Recently, demands for recycling such residual used toner collected by cleaning devices of an image forming apparatus have increased. Mechanisms for conveying collected used toner to a developing unit of the apparatus or to a toner supplying unit which supplies toner to the developing unit have been proposed.

Residual used toner collected by cleaning devices of an image forming apparatus typically includes paper dust produced from a recording sheet. Paper dust is produced, for example, when the recording sheet passes between the transfer device and the photoconductor or the intermediate transfer member. The residual used toner may also include coagulated toner particles which are larger than unused toner particles. If the residual toner is recycled for image formation, paper dust and/or coagulated toner particles included therein may cause abnormal toner images. For example, white spots may be formed in a part of an image formed by toner which includes paper dust. A part of an image formed by toner which includes a large coagulated toner particle may blur.

Therefore, some image forming apparatuses use a net member for separating alien material such as paper dust and/or coagulated toner particles from collected residual used toner to recycle only reusable toner. Because meshes of the net member tend to become clogged by toner and/or paper dust, the net member is typically vibrated to prevent clogging of the meshes of the net member by the paper dust and/or toner.

However, even when the net member is vibrated, meshes of the net member tend to become clogged if a large volume of toner is deposited on the net member. This decreases efficiency of separating reusable toner from the used toner, resulting in reusable toner not being separated from the used toner, with the reusable toner being unnecessarily discarded.

Further, large coagulated toner particles not passing through meshes of the net member may be separated from reusable toner as non-reusable toner and may be unnecessarily discarded even though the toner itself would be reusable if the coagulation were loosened.

SUMMARY OF THE INVENTION

Accordingly, the applicant of the present application has recognized that a need exists for a toner sorting device which efficiently separates reusable toner from used toner collected by an image forming apparatus to recycle the reusable toner.

Accordingly, one object of this invention is to provide a novel toner sorting device for an image forming apparatus, which efficiently separates reusable toner from used toner collected by the image forming apparatus. The present invention also provides a novel image forming apparatus including such a toner sorting device.

One embodiment of the toner sorting device according to the present invention includes an intake device for taking in used toner conveyed from an image forming apparatus and conveying the used toner in one direction, and a sifting device for sifting the used toner conveyed from the intake device to separate reusable toner from the used toner. The sifting device is tubular and has a first opening for receiving the used toner which is conveyed from the intake device to be moved into the sifting device. The sifting device also has a second opening for discharging the remaining toner separated from the reusable toner and remaining inside the sifting device. The toner sorting device further includes a device for collecting the reusable toner separated from the used toner by the sifting device and a device for collecting the remaining toner discharged from the sifting device.

The toner sorting device according to the present invention may further include a device for accelerating sifting of the used toner by the sifting device.

The sifting device according to the present invention may further include a tubular sieve for separating reusable toner from the used toner and a device to hold the sieve so that the sieve is rotatable. The sieve has a first opening for receiving the used toner conveyed from the intake device at a plane on one edge of the sieve and a second opening for discharging the remaining toner separated from the reusable toner and remaining inside the sieve at a plane on the other edge of the sieve.

The sifting device may further include a device to prevent clogging of the meshes of the sieve by the used toner.

The device for accelerating sifting according to the present invention may further include a member for thrusting the used toner conveyed from the intake device against an internal circumferential surface of the sifting device to move reusable toner through meshes of the device to be separated from the used toner.

The device for accelerating sifting may also include a device for shaking off the toner from internal and external circumferential surfaces and meshes of the sifting device.

The device for accelerating sifting may also include a mobile member, inside the sifting device, movably held relative to an inner circumferential surface of the sifting device. The mobile member may be a column or a square pillar.

BRIEF DESCRIPTION OF THE DRAWINGS

A more complete appreciation of the present invention and many of the attendant advantages thereof will be readily obtained by reference to the following detailed description when considered in connection with the accompanying drawings, wherein.

DESCRIPTION OF THE PREFERRED EMBODIMENTS

Figure 1:
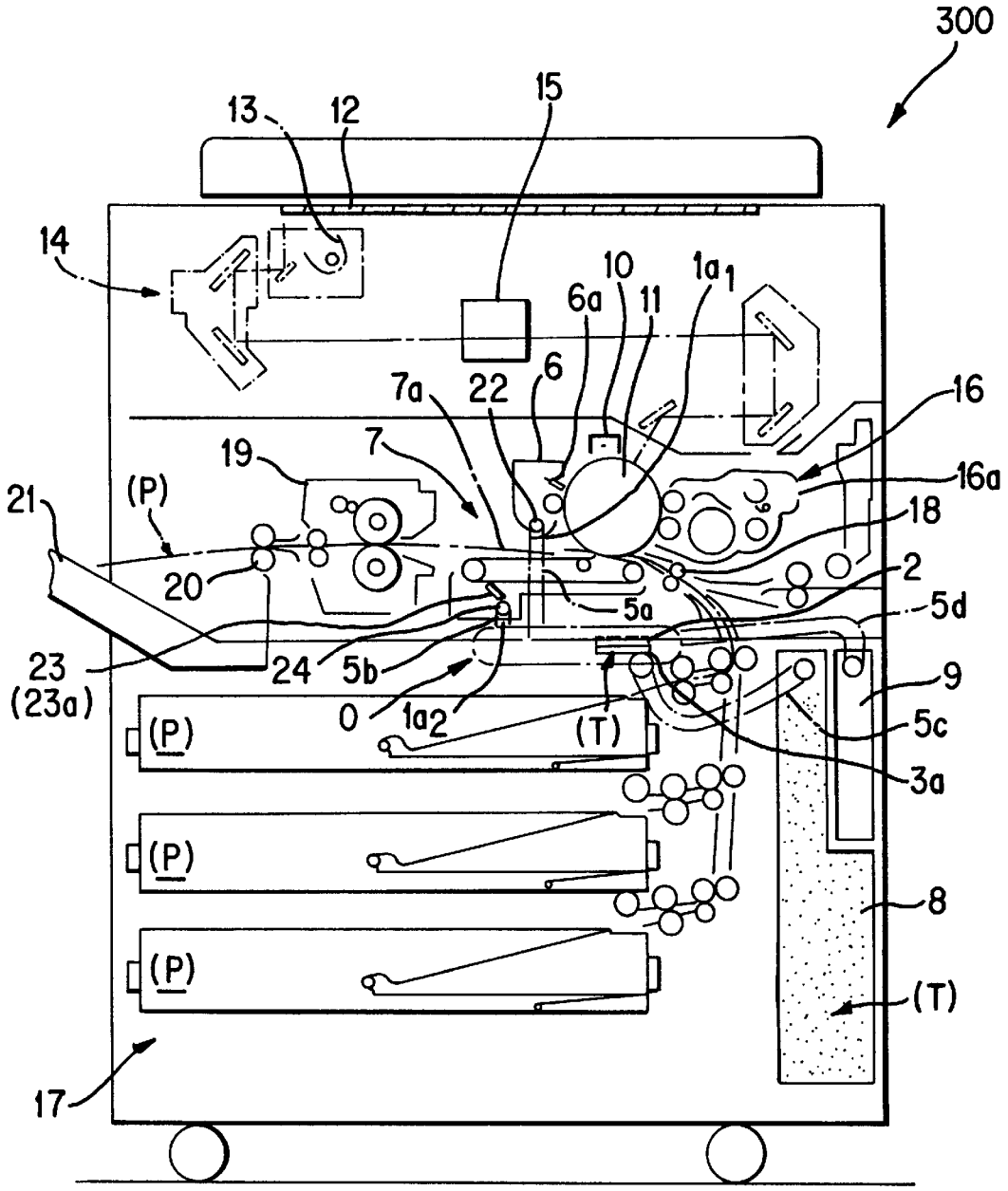
FIG. 1 is a schematic drawing illustrating an exemplary construction of an image forming apparatus according to the present invention.
Figure 2:
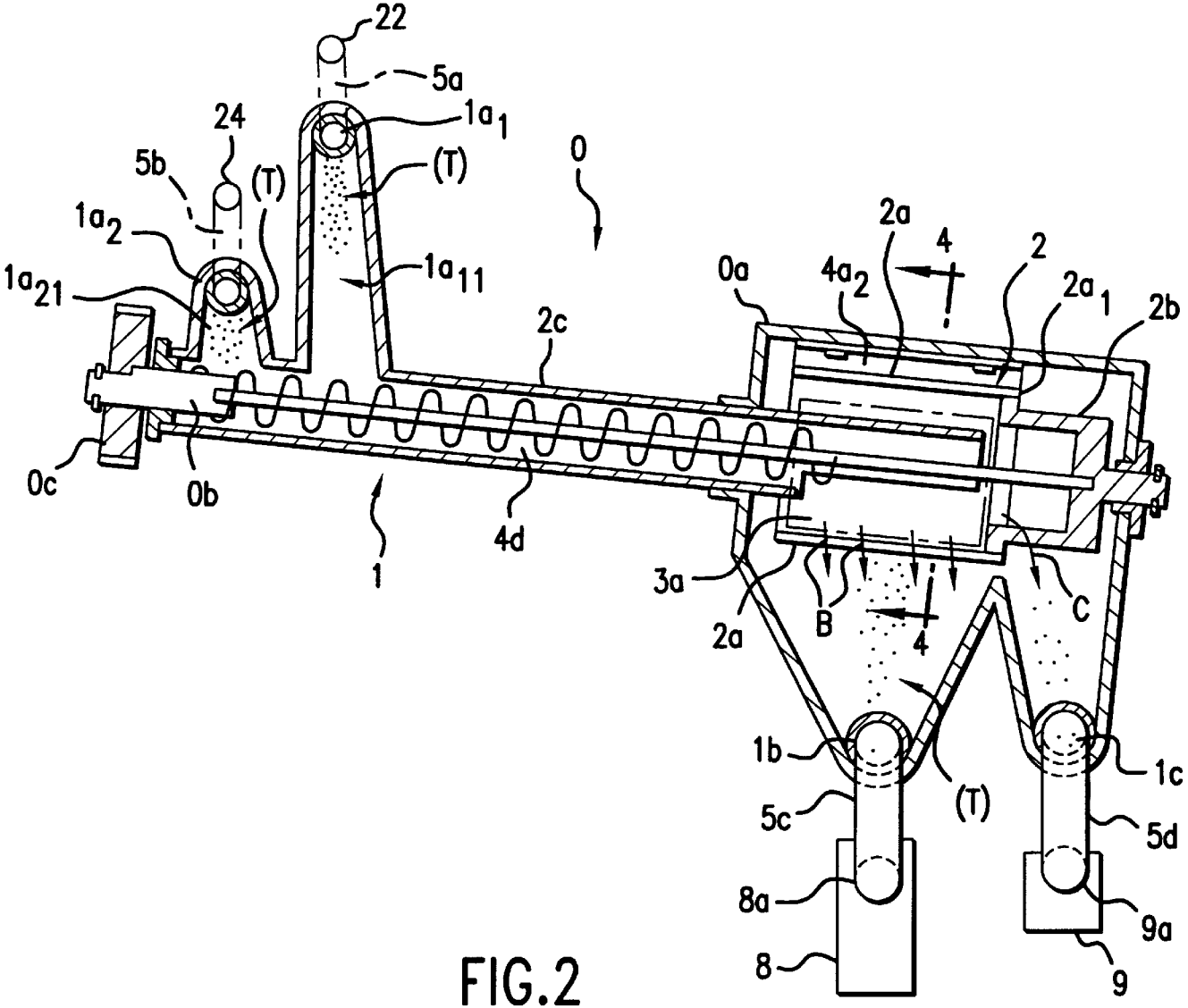
FIG. 2 is a sectional drawing illustrating an example of a toner sorting device according to the present invention.

Referring now to the drawings, wherein like reference numerals designate identical or corresponding parts throughout the several views, and more particularly to FIG. 1 thereof, a schematic drawing of an exemplary construction of an image forming apparatus according to the present invention is illustrated. FIG. 2 is a sectional drawing illustrating an example of a toner sorting device according to the present invention.

Referring to FIG. 1, a photoconductor drum 11 is uniformly charged by a charging unit 10, and then a latent image of an original document (not shown) placed on a contact glass 12 is formed on a surface of the photoconductor drum 11 by means of a lamp 13, a series of mirrors 14 and a lens 15. The latent image is then developed to a visible toner image by a developing unit 16. A recording sheet P is fed from a sheet supply unit 17 and is conveyed through a registration roller 18 to a transfer position where the surface of the photoconductor drum 11 and a transfer belt 7*a* of the transfer device 7 contact. The toner image on the photoconductor drum 11 is transferred to the recording sheet P when the recording sheet P passes through the transfer position. The recording sheet P carrying the toner image is then conveyed to a fixing unit 19 by the transfer belt 7*a*, where the toner image is fixed on the recording sheet P. The recording sheet P carrying the fixed toner image is then moved to an exit tray 21 by an exiting roller 20.

After the toner image on the surface of photoconductor drum 11 is transferred to the recording sheet P, residual toner remaining on the surface of the photoconductor drum 11 is removed by a cleaning blade 6*a* of a photoconductor cleaning device 6. The removed residual toner is conveyed by a conveying screw 22 of the cleaning device 6 to a toner conveying path 5*a* connecting to a toner sorting device 0, which is disposed in a toner conveying path for recycling reusable toner. The toner conveying path 5*a* is made of, for example, a flexible pipe.

After the toner image on the photoconductor drum 11 is transferred to the recording sheet P and the recording sheet P carrying the toner image is conveyed to the fixing unit 19 by the transfer belt 7*a*, residual toner and/or paper dust on a surface of the transfer belt 7*a* is removed by a cleaning blade 23*a* of a transfer belt cleaning device 23. The removed toner and/or paper dust is conveyed by a conveying screw 24 of the belt cleaning device 23 to the toner sorting device 0 via a toner conveying path 5*b* connecting to the toner sorting device 0. The toner conveying path 5*b* is made of, for example, a flexible pipe.

Referring to FIG. 2, the toner sorting device 0 includes an intake unit 1 which receives residual used toner respectively conveyed from the photoconductor cleaning device 6 and the transfer belt cleaning device 23, a sifting unit 2 which separates reusable toner from the used toner and a toner collecting case 0*a* which encloses the sifting unit 2 and which separately collects reusable toner separated from the used toner by the sifting unit 2 and remaining toner discharged from the sifting unit 2.

The intake unit 1 includes a pipe-shaped unit 2*c* which includes a toner intake inlet $1a_1$ for taking in used toner conveyed through the toner conveying path 5*a* from the photoconductor cleaning device 6 and a toner intake inlet $1a_2$ for taking in used toner conveyed through the toner conveying path 5*b* from the transfer belt cleaning device 23. The toner conveying path 5*a* connects to the inlet $1a_1$ and the toner conveying path 5*b* connects to the inlet $1a_2$. The intake unit 1 is formed by toner conveying paths $1a_{11}$ and $1a_{21}$ which connect to a toner conveying path 4*d* connecting to the sifting unit 2. A toner conveying screw 0*b* is provided passing through the toner conveying path 4*d* and is rotated by a driving source (not shown) via a driving gear 0*c*. Toner taken in through the inlets $1a_1$ and $1a_2$ travels through respective paths $1a_{11}$ and $1a_{21}$ to the toner conveying path 4*d* and is conveyed to the sifting unit 2 by the toner conveying screw 0*b*.

The sifting unit 2 includes a tubular sieve 2*a* which separates reusable toner from the used toner conveyed from the intake unit 1 and a holding unit 2*b* which holds the sieve 2*a* so that the sieve 2*a* is rotatable.

For this example, the sieve 2*a* is held by the holding unit 2*b* at an end $2a_1$. The holding unit 2*b* engages with an axis of the toner conveying screw 0*b* and the sieve 2*a* is rotated as the holding unit 2*b* is rotated by rotation of the conveying screw 0*b*. The sieve 2*a* engages with the pipe-shaped unit 2*c* of the intake unit 1 at the other end, and the used toner conveyed by the toner conveying screw 0*b* through the toner conveying path 4*d* passing through the pipe-shaped unit 2*c* is moved into the sieve 2*a* through an opening of the pipe-shaped unit 2*c*. As the sieve 2*a* is rotated, reusable toner is separated from the used toner moved into the sieve 2*a* by passing through meshes of the sieve 2*a*.

The toner collecting case 0*a* is provided with a reusable toner collecting device 1*b* and a remaining toner collecting device 1*c*, for example, at a bottom part. The collecting devices 1*b* and 1*c* are respectively composed of conveying screws in this example. Toner passing through meshes of the sieve 2*a* falls in a direction indicated by arrow "B" into the reusable toner collecting device 1*b* and toner not passing through the meshes is conveyed through an end opening of the sieve 2*a*, which is provided at the side held by the holding unit 2*b*, and falls in a direction indicated by arrow "C" into the remaining toner collecting device 1*c*.

Referring also to FIG. 1, the reusable toner collecting device 1*b* connects to a recyclable toner conveying path 5*c* connecting to a toner collecting opening 8*a* of a recyclable toner bottle 8. Reusable toner collected by the reusable toner collecting device 1*b* is conveyed through the recyclable toner conveying path 5*c* and is put into the recyclable toner bottle 8 through the collecting opening 8*a*. The remaining toner collecting device 1*c* connects to a remaining toner conveying path 5*d* connecting to a toner collecting opening 9*a* of a remaining toner bottle 9, i.e. a toner bottle for collecting remaining toner. Remaining toner collected by the remaining toner collecting device 1*c* is conveyed through the remaining toner conveying path 5*d* and put into the remaining toner bottle 9 through the collecting opening 9*a*.

Figure 3:
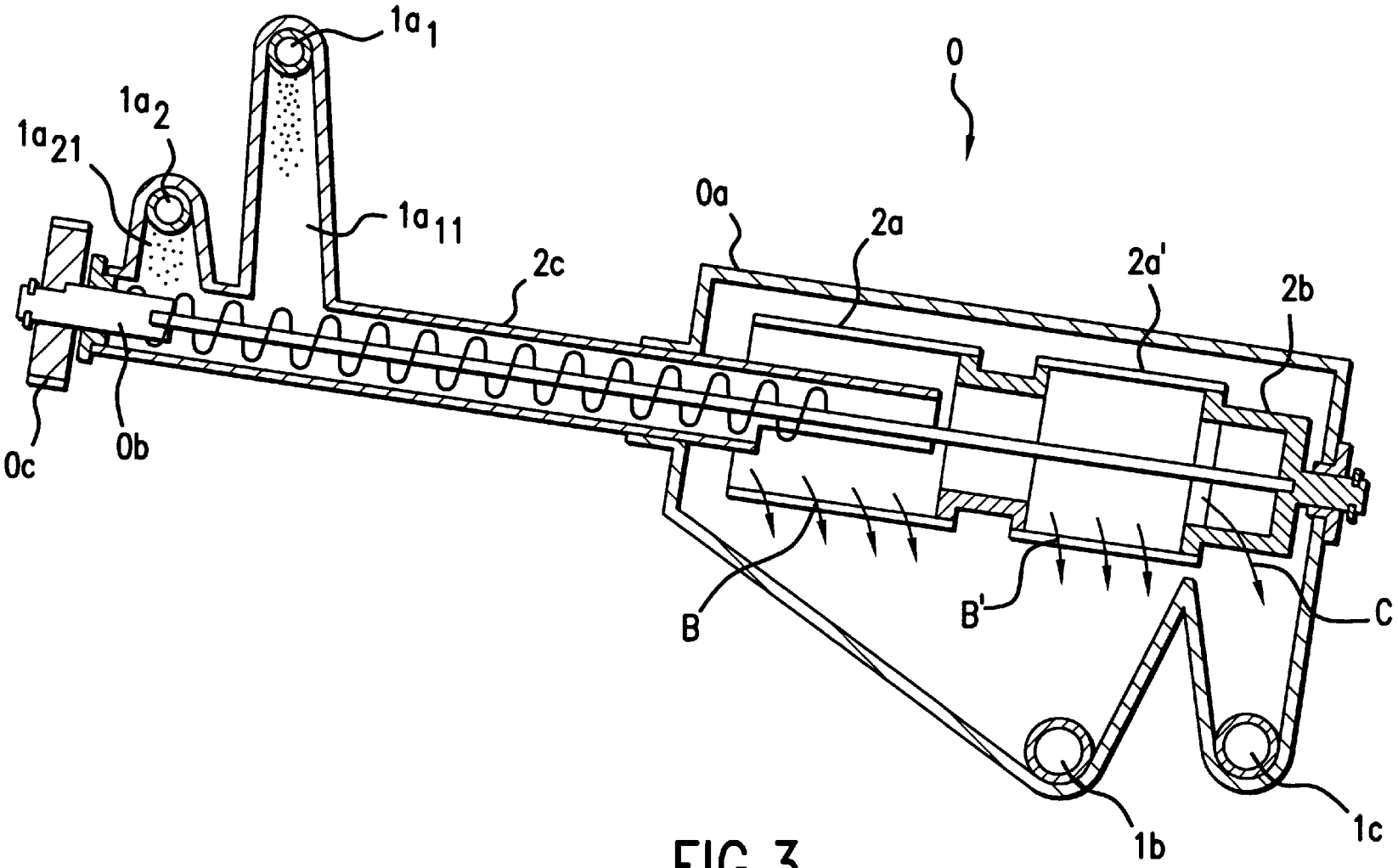
FIG. 3 is a sectional drawing illustrating another example of the toner sorting device according to the present invention.

The toner sorting device 0 can alternatively include a plurality of tubular sieves 2*a* and 2*a*' as shown in FIG. 3. The plurality of sieves 2*a* and 2*a*' is disposed in series in a direction in which collected used toner travels. A first sieve 2*a* in the direction in which the used toner is conveyed is connected with a second sieve 2*a*' via a connecting member and the second sieve 2*a*' is held by the holding unit 2*b* so that the sieves 2*a* and 2*a*' are rotated by the toner conveying screw 0*b*. Toner conveyed into the sifting unit 2 is first moved into the sieve 2*a* for separation. Toner which is not separated by the first sieve 2*a* is conveyed into the second sieve 2*a*' by rotation of the toner conveying screw 0*b*. Reusable toner respectively separated by the first sieve 2*a* and second sieve 2*a*' falls into the reusable toner collecting device 1*b* as indicated by arrows "B" and "B'" respectively. The used toner not separated by the second sieve 2*a*' is discharged from the second sieve 2*a*' and falls into the remaining toner collecting device 1*c* as indicated by an arrow "C."

When a relatively large volume of used toner is conveyed into the toner sorting device 0 having a single sieve 2*a*, as in the embodiment or FIG. 2, it is possible that reusable toner may be unnecessarily discarded. This situation is avoided with the toner sorting device construction described above with regard to FIG. 3.

Figure 4:
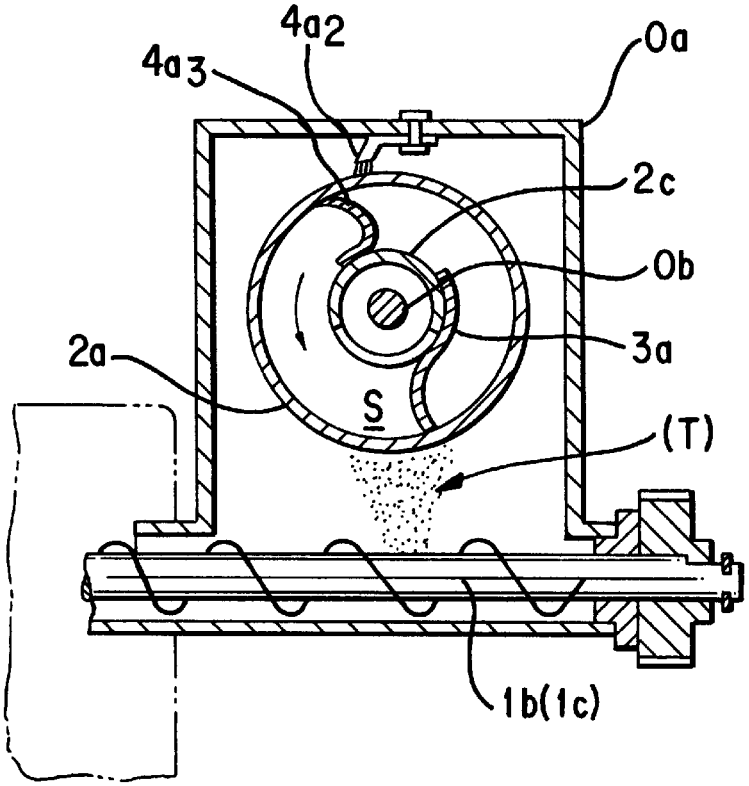
FIG. 4 is a sectional drawing of an exemplary structure of the toner sorting device of FIG. 2 at a position indicated by a dot-and-dash line "A," illustrating examples of a tubular sieve, a device for preventing mesh clogging and a device for accelerating sifting.

FIG. 4 is a sectional drawing of the toner sorting device 0 of FIG. 2 at a position indicated by a dot-and-dash line "A."

As illustrated in FIG. 4, the tubular sieve 2*a* is formed in a shape having a circular cross section in this example. A toner thrusting member 3*a* for accelerating separation of reusable toner from the used toner is disposed inside the sieve 2*a*. The toner thrusting member 3*a* is made of a flexible member, such as a PET film piece. An end of the toner thrusting member 3*a* is attached to a part of the pipe-shaped unit 2*c* of the intake unit 1, which is disposed inside the sieve 2*a* (FIG. 2), and the other end of the toner thrusting member 3*a* is free, so that the free end contacts the internal circumferential surface of the sieve 2*a*.

The used toner moved into the sieve 2*a* is deposited in an area "S" inside the sieve 2*a*. As the sieve 2*a* is rotated, the free end of the toner thrusting member 3*a* presses the toner deposited in the area "S" against the internal circumferential surface of the sieve 2*a*, such that the toner pressed against the sieve 2*a* passes through meshes of the sieve 2*a* and is separated as reusable toner. Thus, separation of reusable toner from the used toner is accelerated by the toner thrusting member 3*a*.

A mesh clog prevention member $\mathbf{4}a_2$, made of a flexible member, such as a PET film piece, is attached to an upper part of the case 0*a* so that a free end of the member $\mathbf{4}a_2$ contacts the outer circumferential surface of the sieve 2*a*. Further, another mesh clog prevention member $\mathbf{4}a_3$, made of a flexible member such as a PET film piece, is attached to the pipe-shaped unit 2*c*, so that the free end of the member $\mathbf{4}a_3$ contacts the internal surface of the sieve 2*a* at a relatively higher position.

As a further feature, the present invention avoids the toner pressed by the toner thrusting member 3*a* against the internal surface of the sieve 2*a* to be moved into the meshes of the sieve 2*a* in the area "S" from remaining inside the meshes, thereby clogging the meshes. As the sieve 2*a* rotates further, a first part of the sieve 2*a* which had been located in the area "S" rises and the outer surface of the first part contacts the mesh clog prevention member $\mathbf{4}a_2$ and the toner clogged inside each mesh of the first part of the sieve is pushed out of the mesh by the member $\mathbf{4}a_2$. As the sieve 2*a* rotates further, the mesh clog prevention member $\mathbf{4}a_3$ contacts the internal surface of the first part of the sieve 2*a* and the toner clogged inside each mesh of the first part, which has not been pushed out by the member $\mathbf{4}a_2$, is pushed out of the mesh by the member $\mathbf{4}a_3$. Clogging of meshes of the sieve 2*a* is thus prevented. Clogging of meshes of the sieve 2*a* may be prevented by having either the preventing member $\mathbf{4}a_2$ in contact with the outer circumferential surface of the sieve 2*a* or by having the preventing member $\mathbf{4}a_3$ in contact with the internal circumferential surface of the sieve 2*a*.

Figure 5:
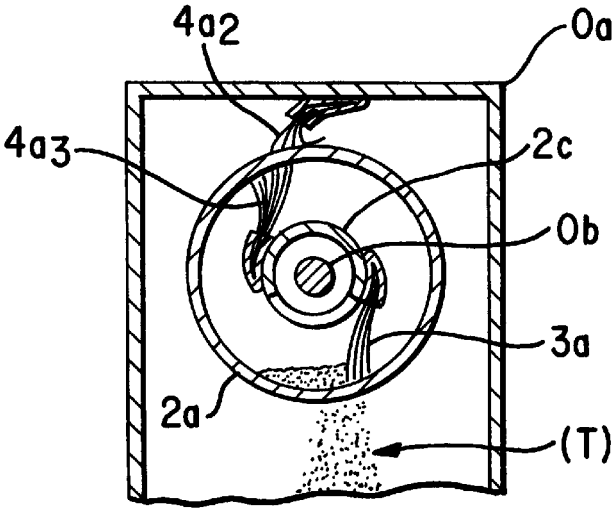
FIG. 5 is a sectional drawing illustrating another example of the device for preventing mesh clogging and the device for accelerating sifting.

The toner thrusting member 3*a* and the mesh clog prevention members $\mathbf{4}a_2$ and $\mathbf{4}a_3$ may be made of, for example, a brush-shaped fur. FIG. 5 illustrates an example of the sorting device 0, in which brush-shaped furs are used for the mesh clog prevention members $\mathbf{4}a_2$ and $\mathbf{4}a_3$ and for the sifting accelerating member 3*a*.

With the sorting device 0 constructed as shown in FIG. 4 or 5, a part of the sieve 2*a* arrives at the area "S" after meshes thereof have any toner clogging the meshes removed by the mesh clog prevention members $\mathbf{4}a_2$ and/or $\mathbf{4}a_3$. Therefore, separation of reusable toner from the used toner is efficiently performed.

Figure 6A:
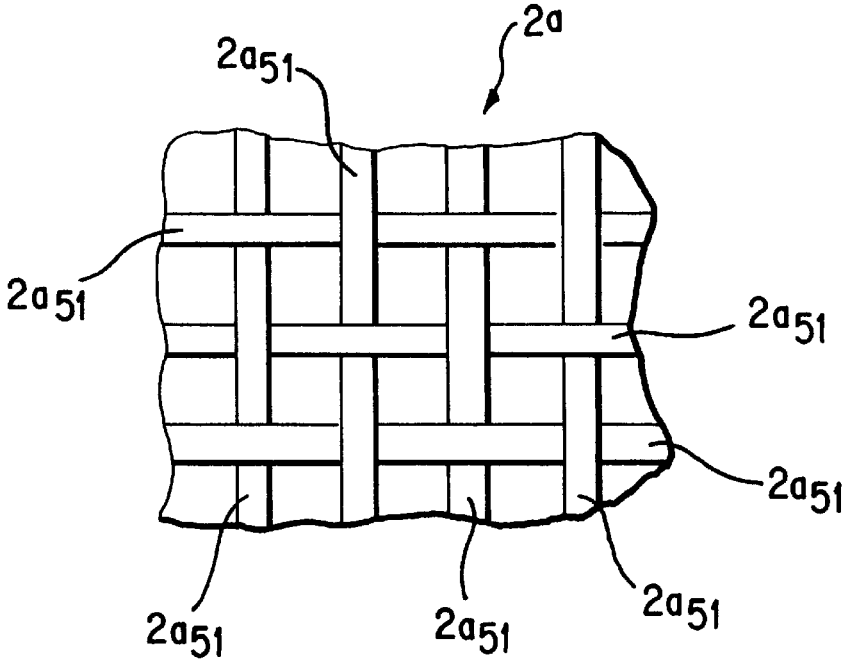
FIGS. 6(*a*) and 6(*b*) are schematic drawings illustrating exemplary structures of the sieve, in which the sieve is made of a net knitted out of wires.
Figure 6B:
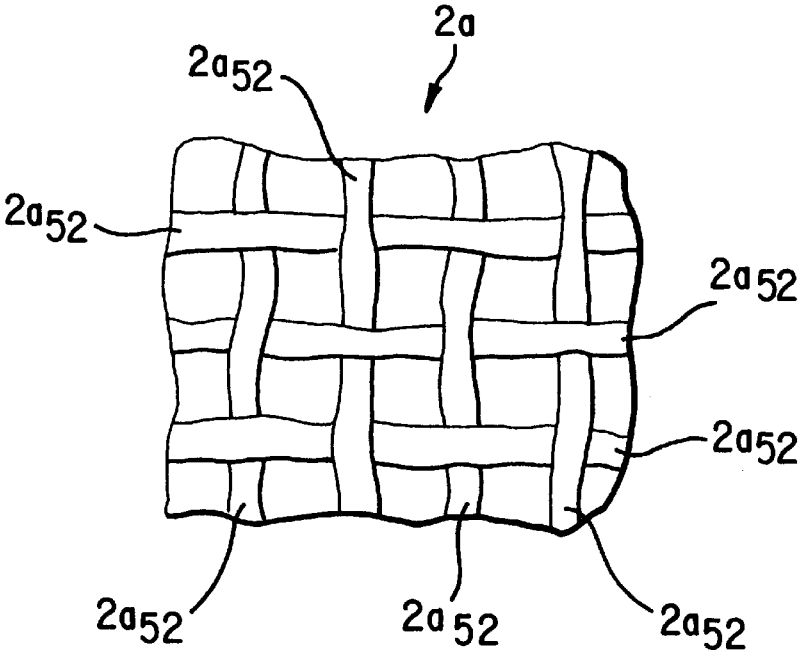

FIGS. 6(*a*) and 6(*b*) are schematic drawings illustrating examples of structures of the sieve 2*a*.

In FIG. 6(*a*), the sieve 2*a* is made of a net knitted out of resin wires $\mathbf{2}a_{51}$, such as polyacetal resin wires, having a diameter of, for example, 0.1 mm. In FIG. 6(*b*), the sieve 2*a* is made of a net knitted out of metal wires $\mathbf{2}a_{52}$, such as stainless wires, having a diameter of, for example, 0.05 mm and 0.1 mm respectively.

The sieve 2*a* may alternatively be made of a closely perforated member. The member may be made of metal or resin.

The size of a mesh of the sieve 2*a* may be determined based upon the size of toner particles and carrier particles used as developer. The size of a mesh of the sieve 2*a* may be made, for example, to be about 2 times to about 50 times the average size of the toner particles and about 7 times the average size of the carrier particles. For example, when the average diameter of the toner particles is 9 $\mu$m and the average diameter of the carrier particles is 70 $\mu$m, meshes of the sieve 2*a* may be formed in 20 to 500 $\mu$m meshes.

Figure 7:
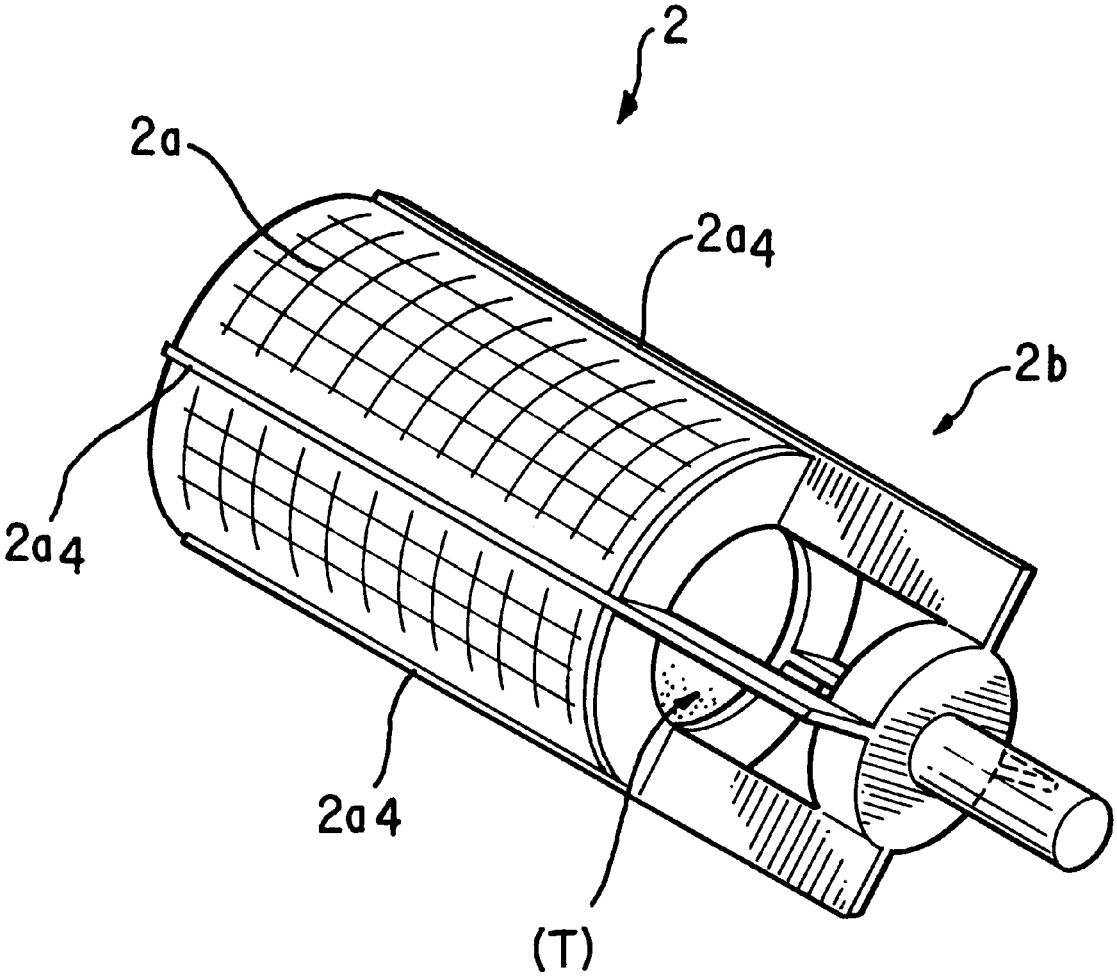
FIG. 7 is a perspective drawing illustrating an exemplary construction of the sieve which is integrated with a holding unit holding the sieve.

FIG. 7 is a perspective drawing illustrating an exemplary construction of the sifting unit 2 according to the present invention, in which the sieve 2*a* and the holding unit 2*b* are integrally formed. As shown in FIG. 7, the sieve 2*a* and a rib $\mathbf{2}a_4$ extending from the holding unit 2*b* in an axial direction of the sieve 2*a* for holding the sieve 2*b* are integrally constructed. Since the sieve 2*a* does not require retention of shape in this construction, any material which will not be affected by toner in quality, such as polyacetal or nylon, may be used for the sieve 2*a*.

Figure 8:
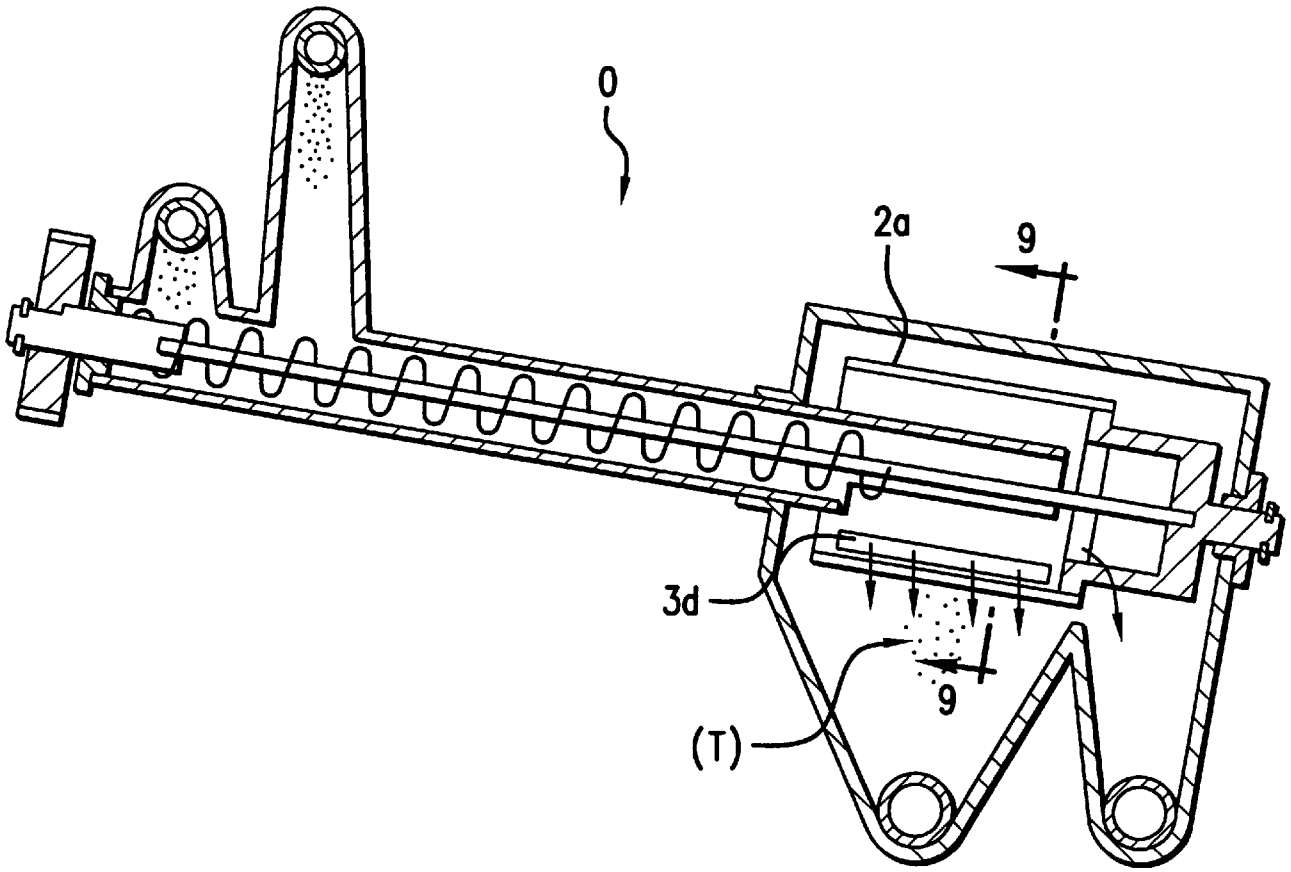
FIG. 8 is a sectional drawing illustrating another example of the toner sorting device according to the present invention, in which a mobile member is enclosed in the sieve for accelerating separation of reusable toner from the used toner moved into the sieve.
Figure 9:
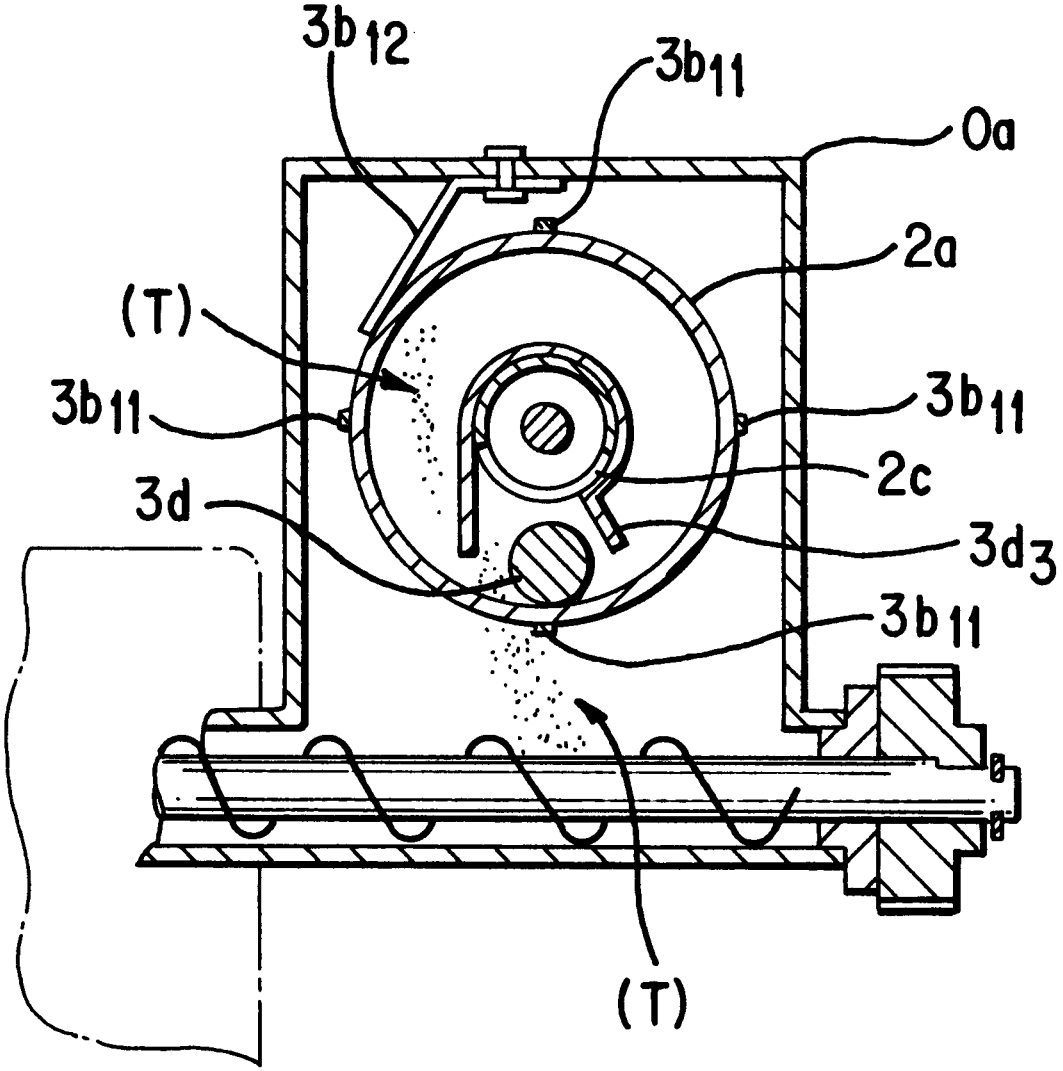
FIG. 9 is a sectional drawing of the toner sorting device of FIG. 8 at a position indicated by a line "A," further illustrating another example of the device for preventing mesh clogging and a guide for the mobile member.

FIG. 8 is a sectional drawing illustrating another example of the toner sorting device 0 according to the present invention, in which a mobile member is enclosed in the sieve 2*a* for accelerating separation of reusable toner from the used toner. FIG. 9 is a sectional drawing of the toner sorting device 0 shown in FIG. 8.

As shown in FIGS. 8 and 9 in this example, a mobile member 3*d* is disposed inside the sieve 2*a*. The member 3*d* is mobile relative to the internal circumferential surface of the sieve 2*a*. The mobile member 3*d* may have a column or a square pillar shape. The mobile member 3*d* may be made of, for example, a metal having a specific gravity heavier than that of the used toner, such as a non-magnetic stainless steel. The member 3*d* rotates as the sieve 2*a* is rotated. As the mobile member 3*d* rotates, the mobile member 3*d* presses the used toner against meshes of the sieve 2*a* to separate reusable toner from the used toner. Also, the mobile member 3*d* stirs the toner inside the sieve 2*a* enhancing fluidity of the toner. Further, the member 3*d* vibrates the sieve 2*a* as the member 3*d* rotates, thereby preventing clogging of meshes of the sieve 2*a* by the toner. Thus, separation of reusable toner from the used toner is further accelerated by the movement of the mobile member 3*d*.

Further, in this example, a plurality of equally spaced protrusions $\mathbf{3}b_{11}$ are provided on the outer circumferential surface of the sieve 2*a* and a spring plate $\mathbf{3}b_{12}$ is attached to an internal surface of the case 0*a* so that the free end of the spring plate $\mathbf{3}b_{12}$ is pressed against the sieve 2*a*, as shown in FIG. 9. As the sieve 2*a* rotates, when the spring plate $\mathbf{3}b_{12}$ contacts the protrusion $\mathbf{3}b_{11}$, the plate $\mathbf{3}b_{12}$ is pushed back against the pressing force of the spring plate $\mathbf{3}b_{12}$. When the plate $\mathbf{3}b_{12}$ passes through the contact with the protrusion $\mathbf{3}b_{11}$, the spring plate $\mathbf{3}b_{12}$ bounces back, causing a vibration to be applied to the sieve 2*a*. The used toner pushed into meshes of the sieve 2*a* and remaining inside the meshes is thrown off the meshes towards the exterior or interior of the sieve 2*a* by this vibration. Thus, clogging of meshes of the sieve 2*a* by the used toner is prevented and efficiency of separating reusable toner from the used toner is further enhanced.

In addition, a guide member $\mathbf{3}d_3$ extending along an axis of the pipe-shaped unit 2*c* is attached to the pipe-shaped unit 2*c*. Both end parts of the guide member $\mathbf{3}d_3$ extend so that the extended parts restrict the space in which the mobile member 3*d* moves, thereby stabilizing the position of the mobile member 3*d* inside the sieve 2*a*. The guide member $3d_3$ also removes toner or paper dust adhering to a surface of the mobile member 3*d* when the mobile member 3*d* contacts the guide member $3d_3$ as the mobile member 3*d* is moved.

Figure 10:
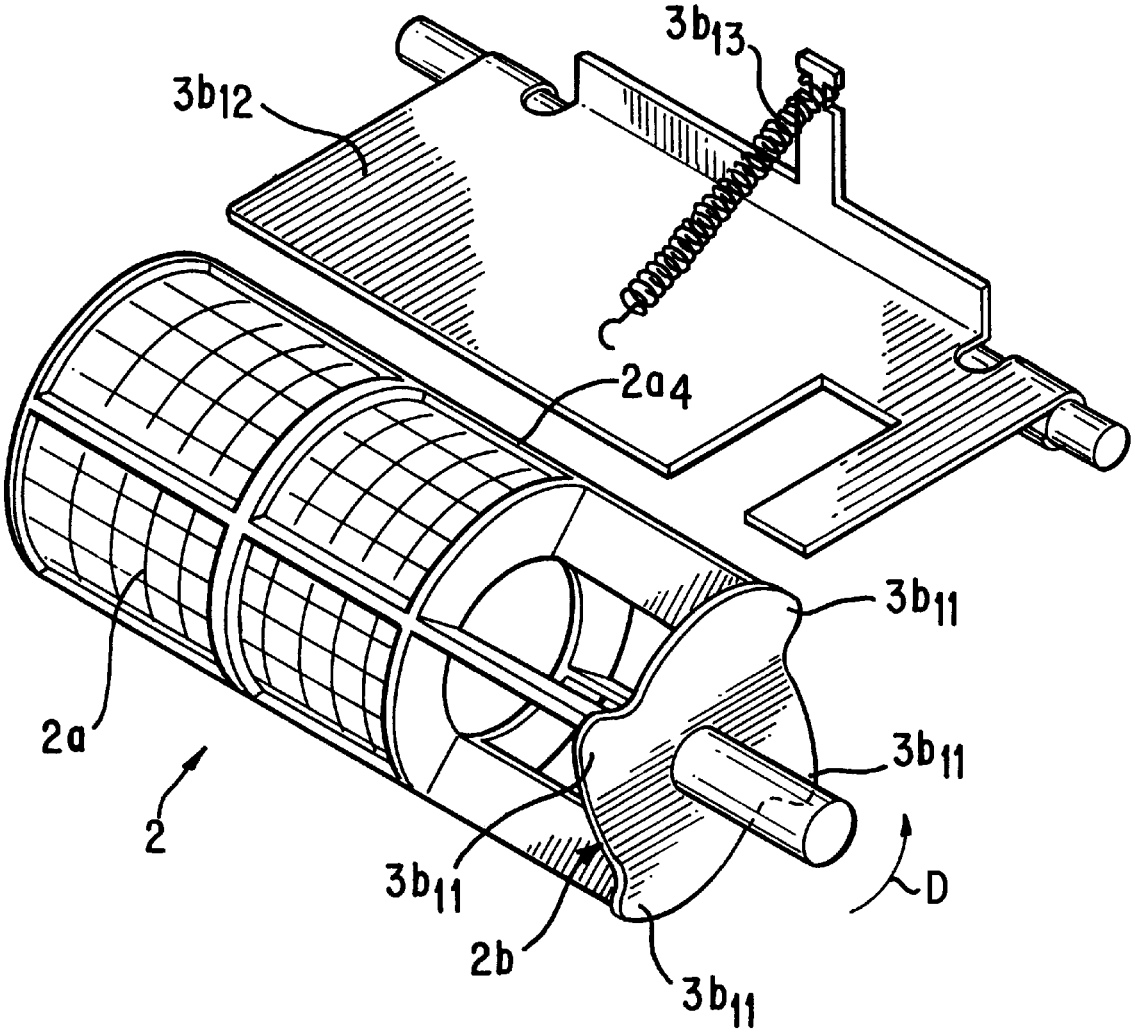
FIG. 10 is a schematic perspective drawing of another example of the sifting unit and the device for preventing mesh clogging.
Figure 11:
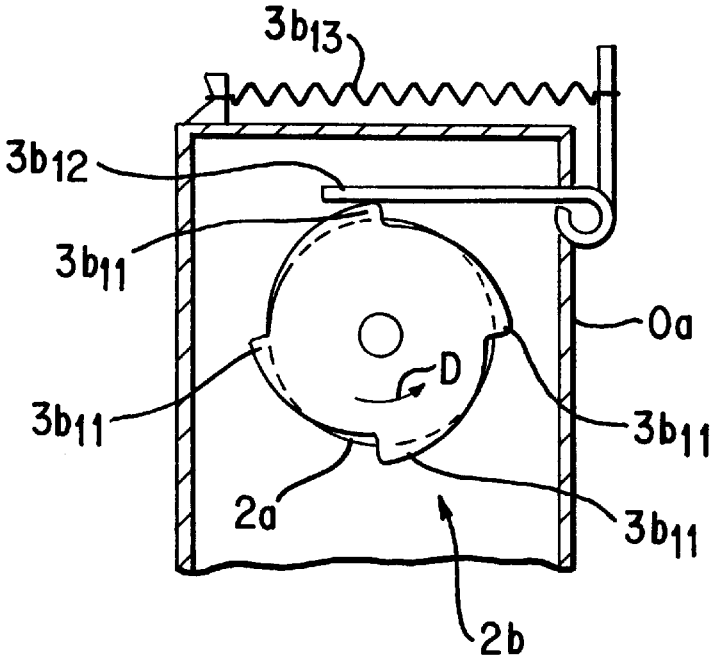
FIG. 11 is a sectional drawing of the sifting unit and the device for preventing mesh clogging shown in FIG. 10.

FIGS. 10 and 11 illustrate an alternative construction of the sifting unit 2 and the mesh clog prevention device according to the present invention. As shown in FIGS. 10 and 11, a plurality of equally spaced protrusions $3b_{11}$ is provided on the outer circumferential surface of the holding unit 2*b*. A pressing member $3b_{12}$ is rotatably attached to a side part of the toner collecting case 0*a* and is pressed against the rib $2a_4$ of the sieve 2*a* and the holding unit 2*b* by a thrusting device $3b_{13}$ made of, for example, a spring attached to the exterior surface of the upper part of the case 0*a* so that a free end part of the pressing member $3b_{12}$ contacts the rib $2a_4$ and the outer circumferential surface of the holding unit 2*b*. As the sifting unit 2 is rotated in a direction "D," when the free end part of the pressing member $3b_{12}$ contacting the outer circumferential surface of the holding unit 2*b* and being pressed against the holding unit 2*b* passes the protrusion $3b_{11}$, the part of the pressing member $3b_{12}$ contacting the holding unit 2*b* falls on the non-protruded portion of the outer circumferential surface of the holding unit 2*b*. At substantially the same time the part of the pressing member $3b_{12}$ extending over the sieve 2*a* contacts the rib $2a_4$, to thereby vibrate the sieve 2*a*. The vibration prevents clogging of meshes of the sieve 2*a* by the used toner.

Figure 12:
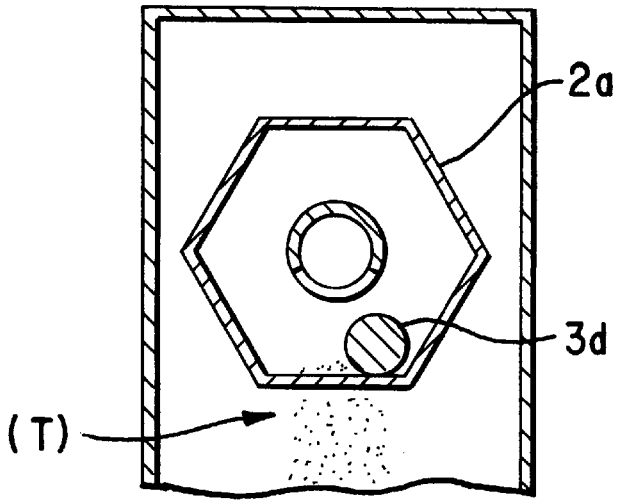
FIG. 12 is a sectional drawing illustrating still another example of the sifting unit, in which the sieve has a polygonal cross section.

FIG. 12 illustrates still another example of the sifting unit 2 of the toner sorting device 0 of FIG. 1 according to the present invention. As shown in FIG. 12, the sieve 2*a* has a hexagonal cross section. A cylindrical mobile member 3*d* is held inside the sieve 2*a*. As the sieve 2*a* rotates, the cylindrical mobile member 3*d* rolls and bounces. Toner sandwiched between the rolling mobile member 3*d* and the internal circumferential surface of the sieve 2*a* is pressed against the sieve 2*a* by the rolling mobile member 3*d*, and the pressed toner is pushed into meshes of the sieve 2*a* such that the toner passes through the meshes. Further, the sieve 2*a* is vibrated by bouncing movement of the rolling mobile member 3*d*, thereby preventing clogging of meshes of the sieve 2*a* by the toner.

Figure 13:
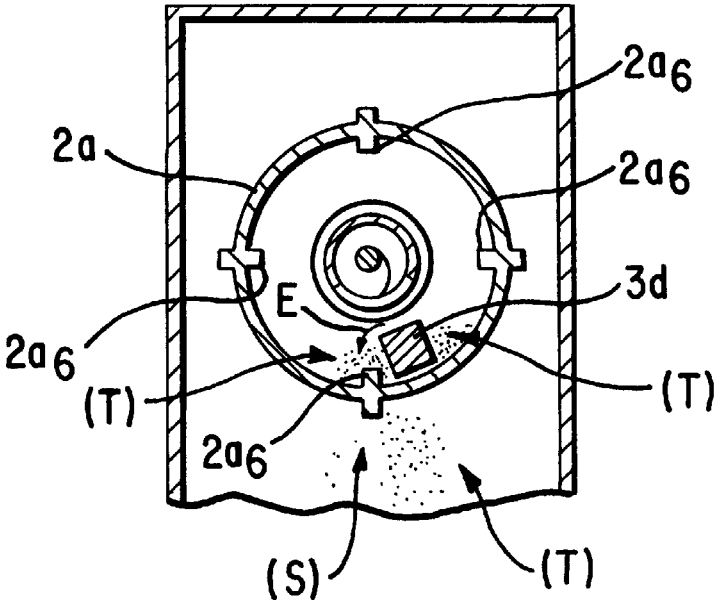
FIG. 13 is a sectional drawing illustrating another example of the sifting unit, in which the sieve is provided with a plurality of protrusions on the internal circumferential surface extending in the axial direction and a mobile member having a square pillar shape is held inside the sieve.

FIG. 13 illustrates still another example of the sifting unit 2 of the toner sorting device 0 of FIG. 1 according to the present invention. As shown in FIG. 13, the sieve 2*a* is provided with a plurality of protrusions $2a_6$ on the internal circumferential surface extending in the axial direction and a mobile member 3*d* having a square pillar shape is held inside the sieve 2*a*. The mobile member 3*d* rolls as the sieve 2*a* is rotated and bounces when rolling over the protrusions $2a_6$. As the mobile member 3*d* rolls over the toner in the area "S," the toner sandwiched between the rolling mobile member 3*d* and the internal surface of the sieve 2*a* is pressed against the sieve 2*a* so that the toner is pushed into meshes of the sieve 2*a* to pass through the meshes. The toner in the area "S" is stirred by the rolling and bouncing movement of the mobile member 3*d*, thereby enhancing fluidity of the toner. The toner is carried on the surface of the mobile member 3*d*, conveyed in a direction indicated by an arrow "E" and is moved back into the area "S" as the mobile member 3*d* rolls, further enhancing the fluidity of the toner. Coagulated toner is also broken into fragments by the rolling and bouncing movement of the mobile member 3*d*. The bouncing movement of the mobile member 3*d* applies a vibration to the sieve 2*a*, thereby preventing clogging of meshes of the sieve 2*a*. Thus, separation of reusable toner from the used toner is accelerated.

Figure 14:
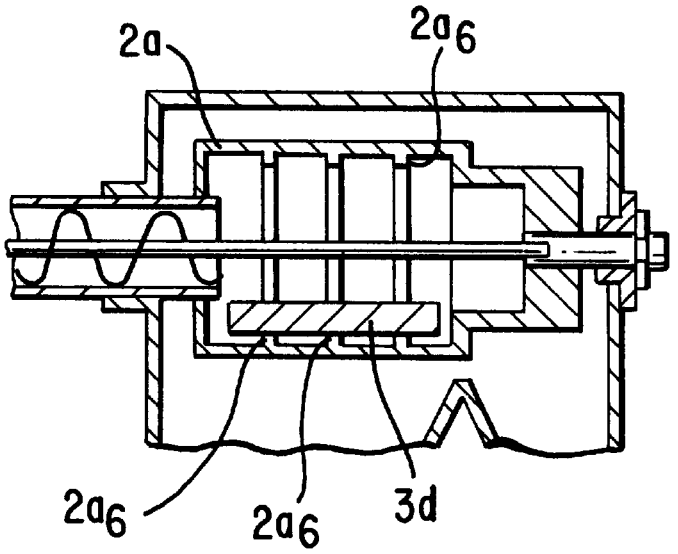
FIG. 14 is a sectional drawing illustrating still another example of the sifting unit, in which a plurality of protrusions is provided on the internal surface of the sieve extending along the circumferential direction and a mobile member is held inside the sieve.

FIG. 14 illustrates still another example of the sifting unit 2 of the toner sorting device 0 of FIG. 1 according to the present invention. In this example, a plurality of protrusions $2a_6$ are provided on the internal surface of the sieve 2*a* extending along the circumferential direction. A mobile member 3*d* rolls while being held by the protrusions $2a_6$ and does not directly contact the surface of the sieve 2*a*, thereby extending the lifetime of the sieve 2*a*. Alternatively, if the sieve 2*a* is knitted by wires, finer wires may be used for the sieve 2*a*, enabling formation of a larger number of meshes to give higher productivity of separating reusable toner from the used toner.

Figure 15A:
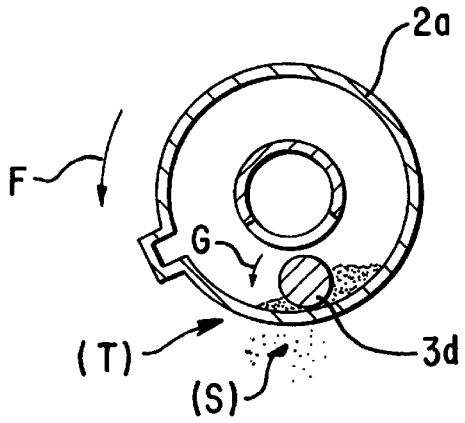
FIGS. 15(*a*), 15(*b*) and 15(*c*) are sectional drawings illustrating another example of the sieve having a concave for gathering and carrying remaining toner.
Figure 15B:
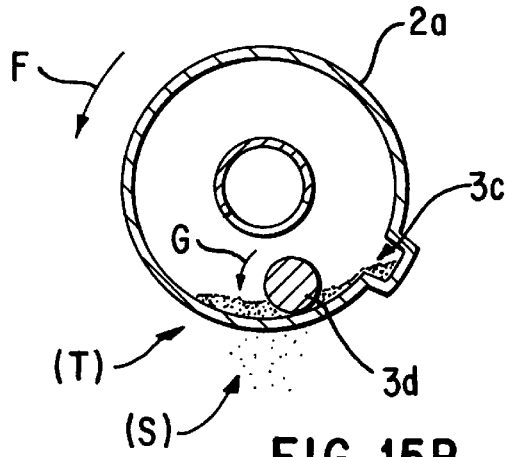
Figure 15C:
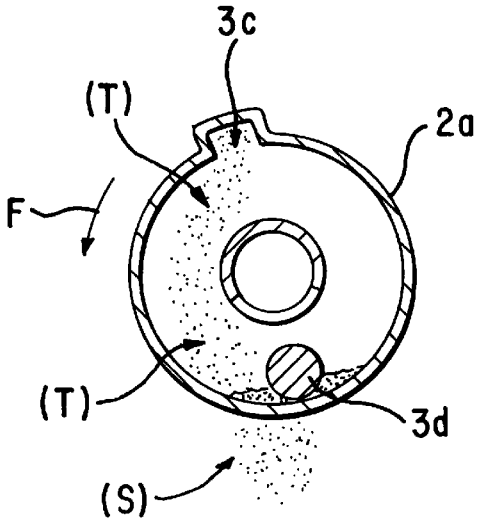

FIGS. 15(*a*), 15(*b*) and 15(*c*) illustrate another example of the sifting unit 2 of FIG. 1 according to the present invention. As shown in FIGS. 15(*a*)–15(*c*), a concave portion 3*c* is formed in the internal surface of the sieve 2*a* extending in the axial direction and a mobile member 3*d* is enclosed inside the sieve 2*a*. As the sieve 2*a* rotates in a direction "F," the mobile member 3*d* rotates in a direction "G." The toner not passing through meshes of the sieve 2*a* and remaining in the area "S" is moved by the rolling movement of the mobile member 3*d* downstream of the mobile member 3*d* in the rotating direction of the sieve 2*a* as shown in FIG. 15(*a*). As the sieve 2*a* rotates further, the moved toner is moved into the concave portion 3*c* and is carried by the concave portion 3*c*, as illustrated in FIG. 15(*b*). As the sieve 2*a* rotates further, when the concave portion 3*c* arrives at an upper position the toner carried by the concave portion 3*c* falls into the area "S," as illustrated in FIG. 15(C). The toner in the area "S" is pressed by the mobile member 3*d* again so that the pressed toner passes through meshes of the sieve 2*a* to be separated out as reusable toner. Since the toner carried by the concave portion 3*c* falls from a high position, fluidity of the fallen toner is enhanced and consequently separation of reusable toner from the used toner is accelerated. Further, since the used toner not passing through the sieve 2*a* is repeatedly moved back into the separating area "S" for separation, any unnecessary discard of reusable toner is minimized.

Figure 16:
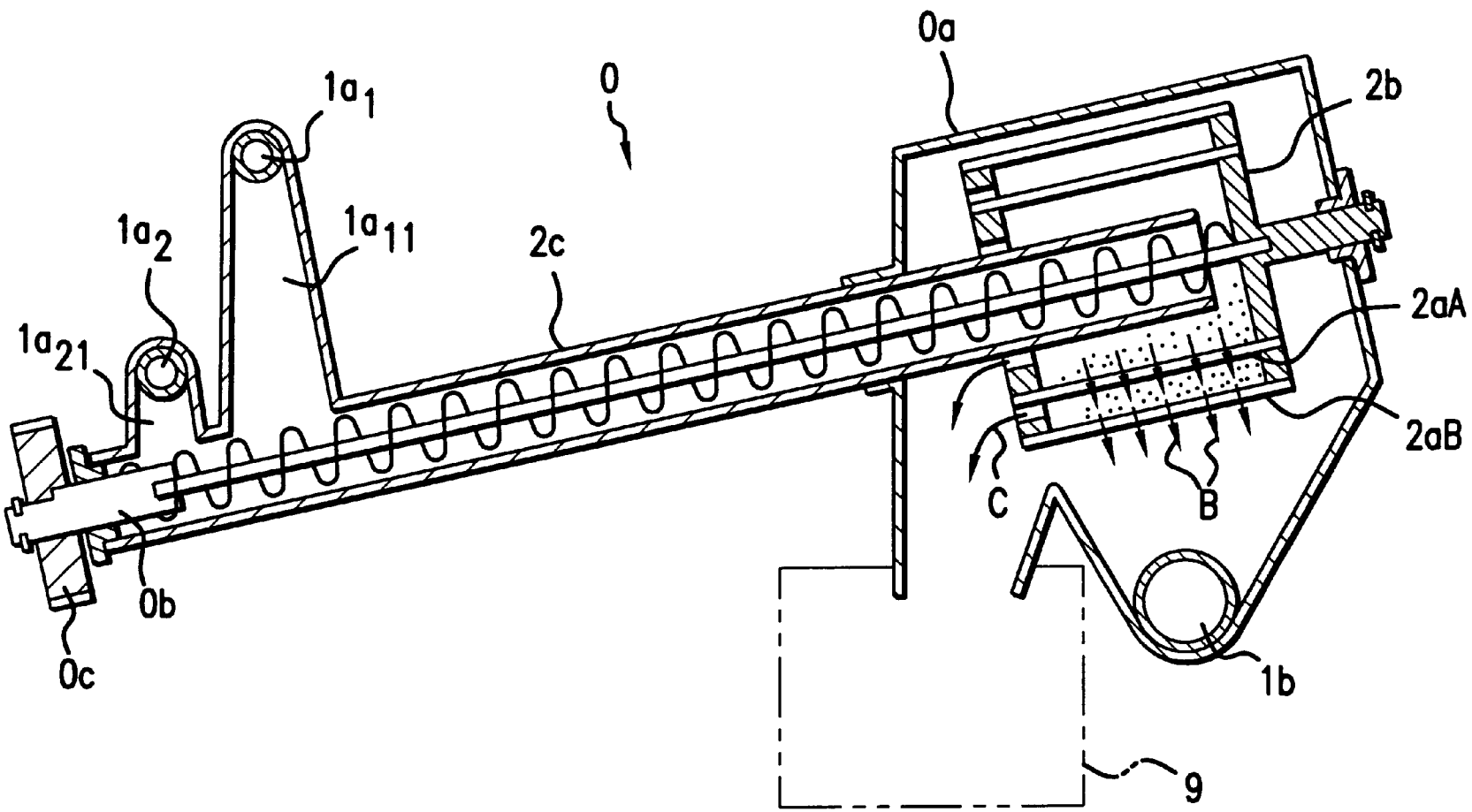
FIG. 16 is a sectional drawing illustrating an alternative exemplary construction of the toner sorting device according to the present invention, in which a plurality of sieves is provided overlapping with each other.

FIG. 16 is a sectional drawing illustrating an alternative exemplary construction of the toner sorting device 0 according to the present invention, in which an overlapped plurality of sieves is provided. As shown in FIG. 16, a concentrically overlapped plurality of tubular sieves 2*a*B and 2*a*A is held by the holding unit 2*b* so that the sieves 2*a*B and 2*a*A are rotatable. Meshes of the outer sieve 2*a*B are made in a size appropriate for separating reusable toner from the used toner. Meshes of the inner sieve 2*a*A are made in a size larger than that of the outer sieve 2*a*B.

The used toner conveyed into the sieve 2*a* is moved inside the inner sieve 2*a*A. Large toner particles, such as coagulated toner, are separated by the inner sieve 2*a*A and are discharged from the inner sieve 2*a*A, as the sieve 2*a*A is rotated, to be collected into the remaining toner bottle 9 as indicated by the arrow "C." The toner passing through the inner sieve 2*a*A is moved into the outer sieve 2*a*B. Reusable toner is separated by the outer sieve 2*a*B to fall on the reusable toner collecting device 1*b* as indicated by the arrow "B." The toner remaining inside the outer sieve 2*a*B is discharged from the outer sieve 2*a*B to be collected into the remaining toner bottle 9 as indicated by the arrow "C."

With the above construction, since large toner particles are separated by the inner sieve 2*a*A and the volume of the toner arriving at the outer sieve 2*a*B is reduced, reusable toner is separated from the used toner relatively efficiently at the outer sieve 2*a*B.

Figure 17:
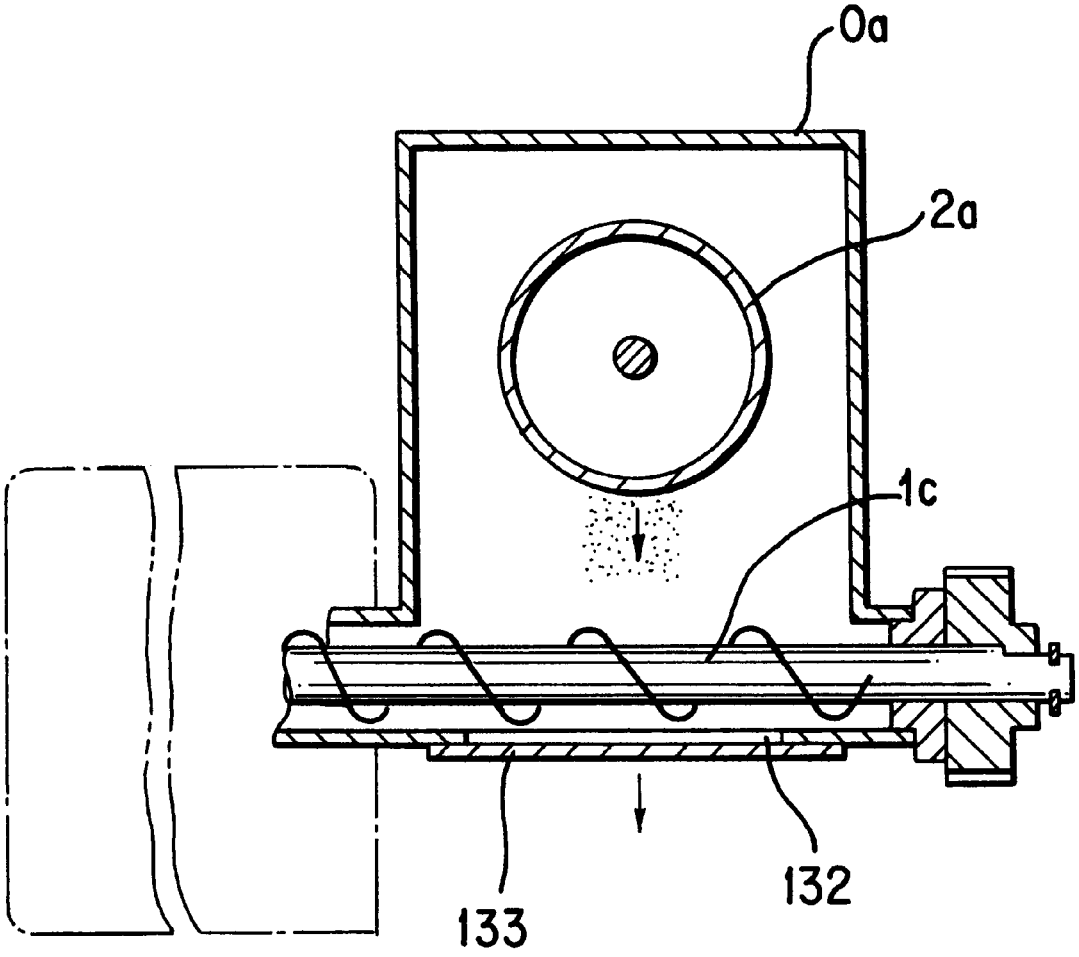
FIG. 17 is a sectional drawing showing another alternative exemplary construction of the toner sorting device according to the present invention, in which an opening is provided beneath a remaining toner collecting device for discharging remaining toner which has overflowed from the collecting device.

FIG. 17 is a sectional drawing showing an alternative exemplary construction of the toner sorting device 0 of FIG. 1 according to the present invention, in which a device for discharging the remaining toner which has overflowed from the remaining toner collecting device 1*c* from the device at a predetermined timing is provided.

If a relatively large volume of residual toner is conveyed to the toner sorting device 0, all of the remaining used toner may not be collected by the collecting device 1*c* and the remaining toner may overflow from the collecting device 1*c* and deposit inside the case 0*a*. To prevent such a case, the toner collecting case 0*a* in FIG. 17 is provided with an opening 132 beneath the collecting device 1*c*. The opening 132 is normally closed by a lid 133, which is movable to open or close the opening 132 by, e.g., a solenoid and a cam (not shown). The opening 132 is opened at a predetermined timing, for example, when a predetermined time has elapsed after starting an operation of the toner sorting device 0 or when a certain number of prints have been made by the image forming apparatus. When the opening 132 is opened, the toner remaining inside the case 0*a* falls downward and is discharged out of the sorting device 0. The discharged toner may be, for example, directly discharged into the remaining toner bottle 9 (see FIG. 16) disposed below the opening 132.

Figure 18:
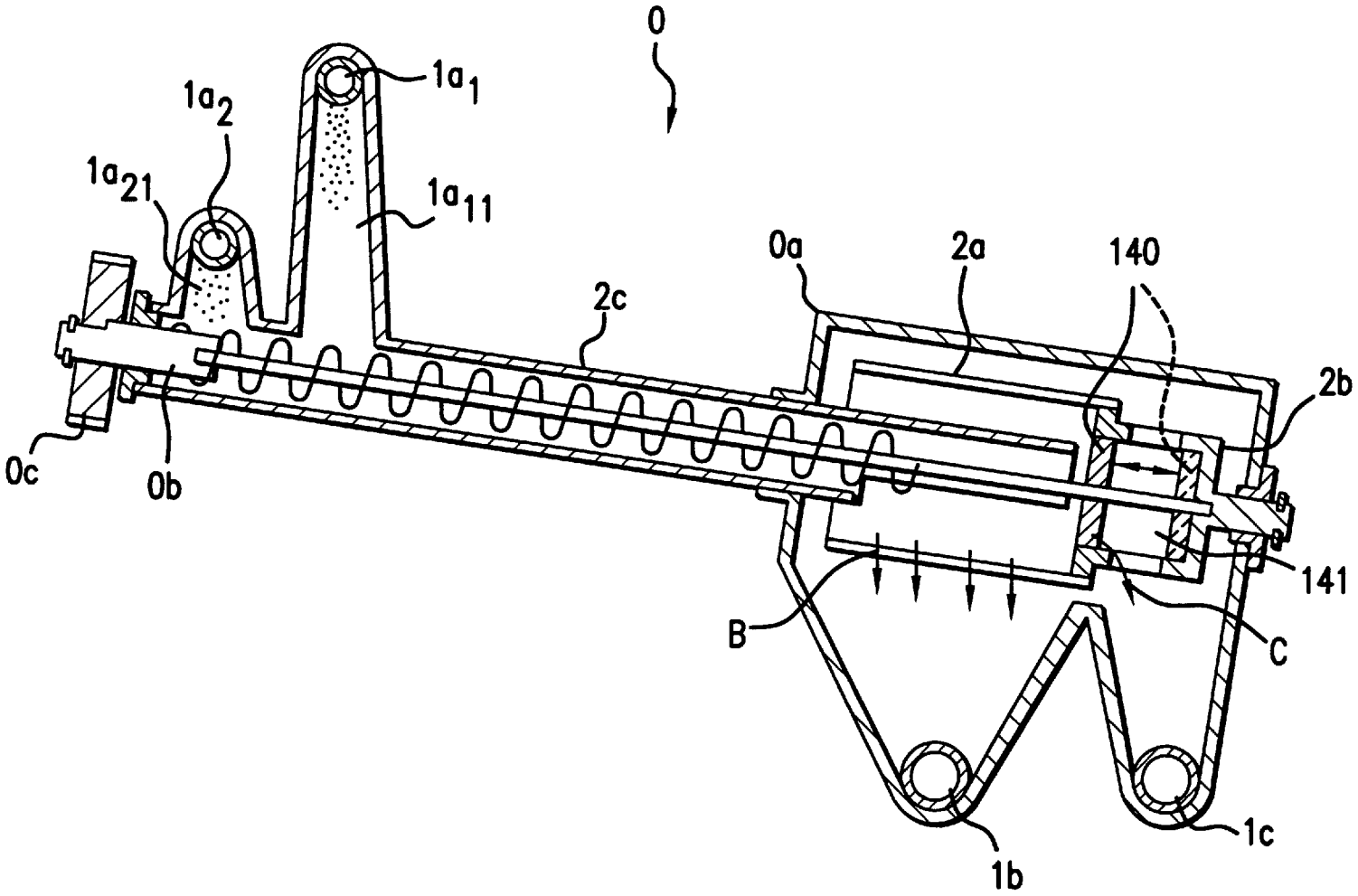
FIG. 18 is a sectional drawing illustrating still another alternative exemplary construction of the toner sorting device according to the present invention, in which a lid for closing an opening for discharging remaining toner from the sieve is provided.

FIG. 18 is a sectional drawing illustrating still another alternative exemplary construction of the toner sorting device 0 according to the present invention. In this example, the sifting unit 2 of FIG. 1 includes a lid member 140 for closing an opening 141 for discharging the remaining used toner from the sieve 2*a*. The lid member 141 is placed to move in a direct line between a position closing the path 141 as illustrated and a position opening the opening 141 as illustrated by a dotted line in FIG. 18. The lid member 140 is moved by a driving device, e.g., including a solenoid and a cam (not shown).

The lid member 140 is kept in the position closing the opening 141, for example, for a predetermined period of time or until a certain number of prints have been made by the image forming apparatus, after the sorting device 0 starts operating. The toner inside the sieve 2*a* is sorted repeatedly during this time period. Reusable toner is thereby separated from the used toner and any unnecessary discard of reusable toner is avoided. The lid member 140 returns to the position opening the path 141 when the above condition is met. When the lid member 140 opens, the toner remaining inside the sieve 2*a* is discharged from the sieve 2*a* through the opening 141 to fall towards the remaining toner collecting device 1*c* through an opening of the holding unit 2*b* as indicated by the arrow "C."

Figure 19:
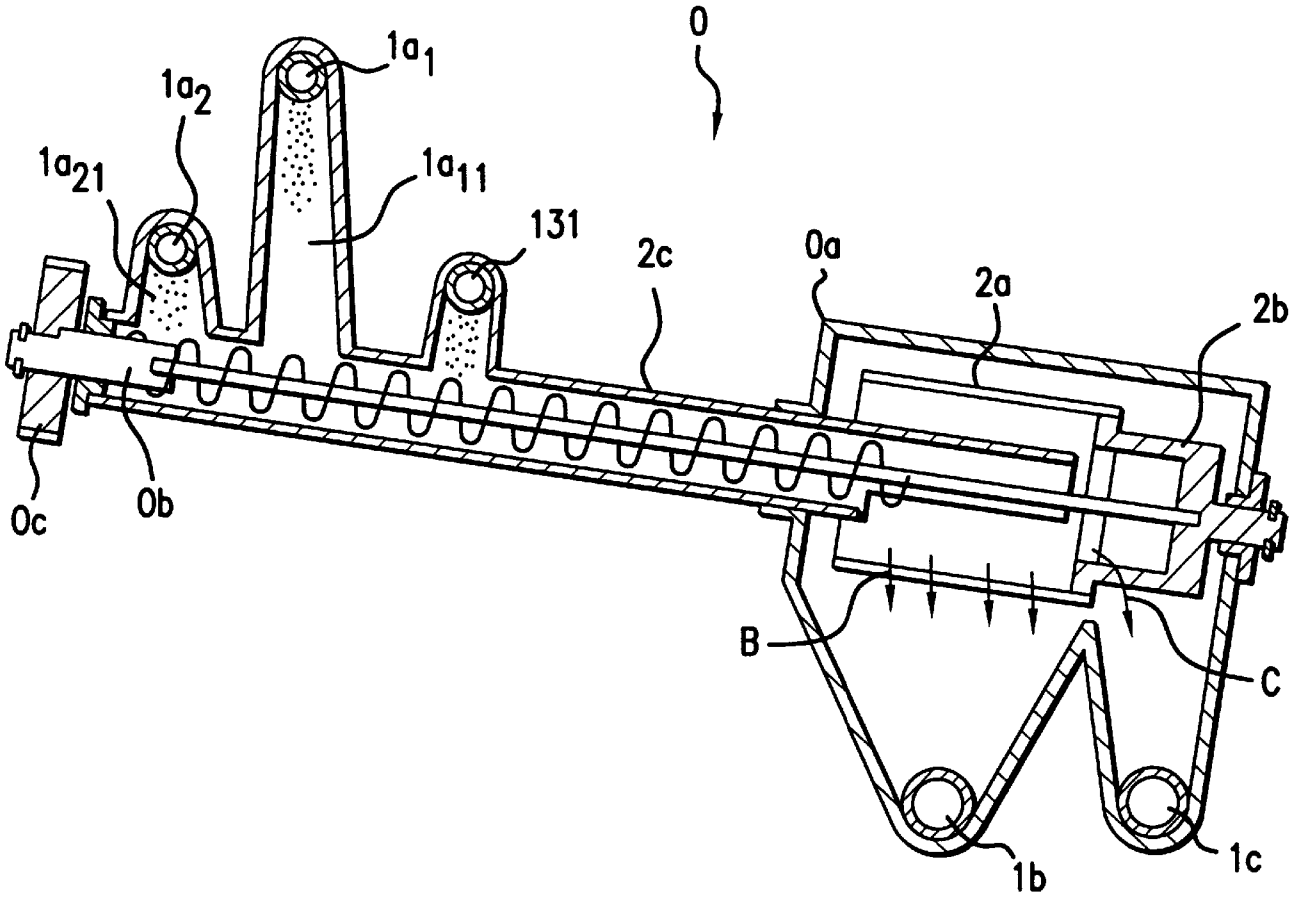
FIG. 19 is a sectional drawing illustrating another exemplary construction of the toner sorting device according to the present invention, in which a device for returning remaining toner collected by a remaining toner collecting device to the sorting device is provided for avoiding unnecessary discard of reusable toner.

FIG. 19 is a sectional drawing illustrating another exemplary construction of the toner sorting device 0 according to the present invention, in which a device for returning the remaining toner collected by the remaining toner collecting device 1*c* to the toner sorting device 0 is provided to avoid any unnecessary discard of reusable toner.

As shown in FIG. 19, a toner returning inlet 131 is provided to the intake unit 1 in parallel with the inlets $1a_2$ and $1a_1$. The remaining toner collecting device 1*c* connects to the toner returning inlet 131 through a flexible toner conveying pipe (not shown). Toner collected by the remaining toner collecting device 1*c* is conveyed to the toner returning inlet 131 via the flexible toner conveying pipe to be returned to the toner sorting device 0. Thus, discard of reusable toner is minimized.

Reusable toner thus collected in the reusable toner bottle 8 of FIG. 1 can be manually placed in the toner hopper 16*a* of the developing unit 16 of FIG. 1 for reuse in the image forming apparatus. To eliminate manual placement, a mechanism for conveying reusable toner to the toner hopper 16*a* may be provided.

Figure 20:
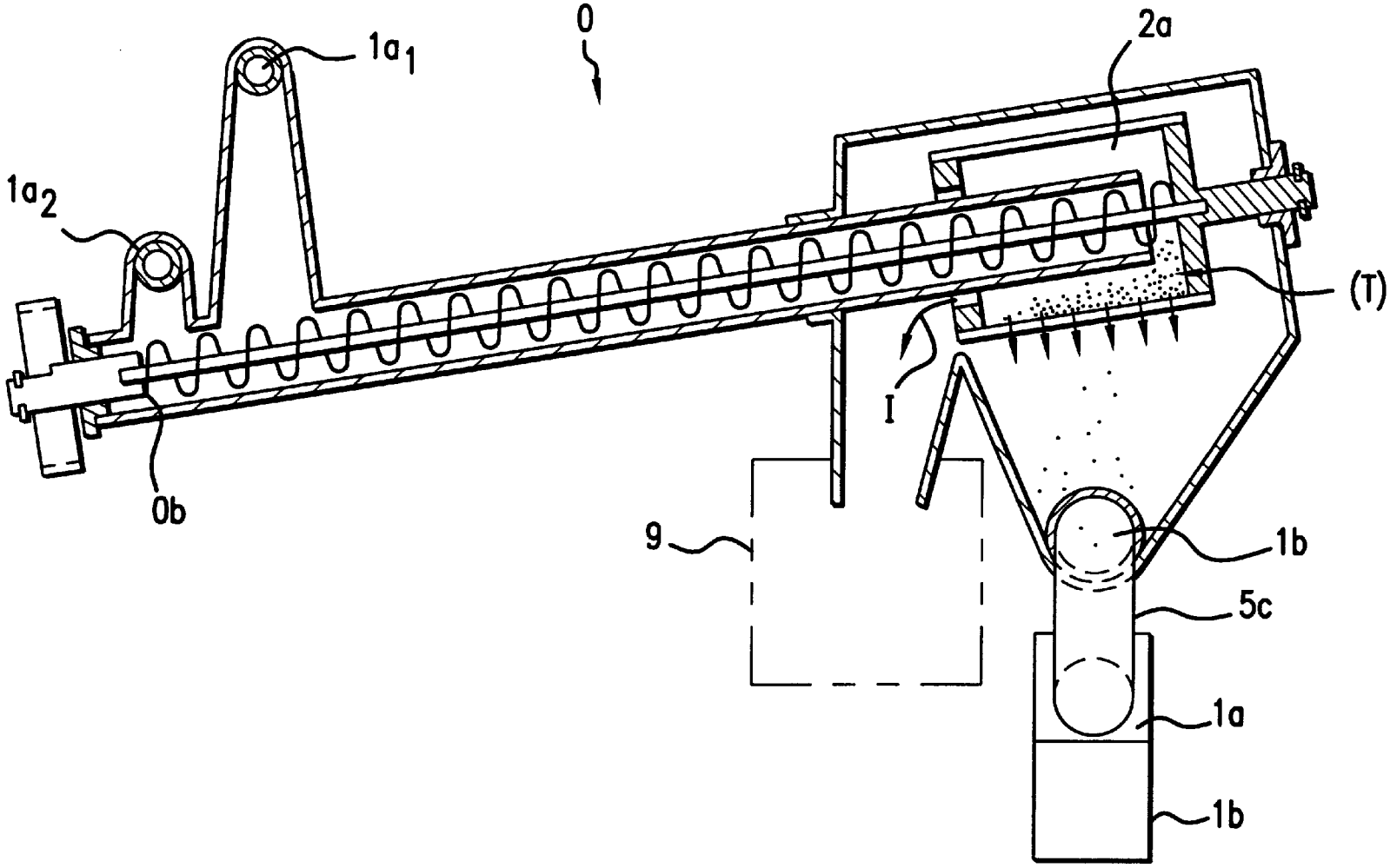
FIG. 20 is a sectional drawing showing still another exemplary construction of the toner sorting device according to the present invention, wherein the toner sorting device conveys collected reusable toner to a toner hopper of an image forming apparatus.

FIG. 20 is a sectional drawing illustrating an exemplary construction of a toner sorting device according to the present invention, which conveys reusable toner collected by the toner sorting device to a toner hopper of an image forming apparatus.

As shown in FIG. 20, the reusable toner collected by the reusable toner collecting device 1*b* of the toner sorting device 0 is conveyed to the toner hopper 16*a* of the developing unit 16 of the image forming apparatus 300 (FIG. 1) via the reusable toner conveying path 5*c*. The remaining toner discharged from the sieve 2*a* is, in this example, collected in the discardable toner bottle 9 disposed beneath the sifting unit 2 of FIG. 1, as indicated by an arrow "I."

Figure 21:
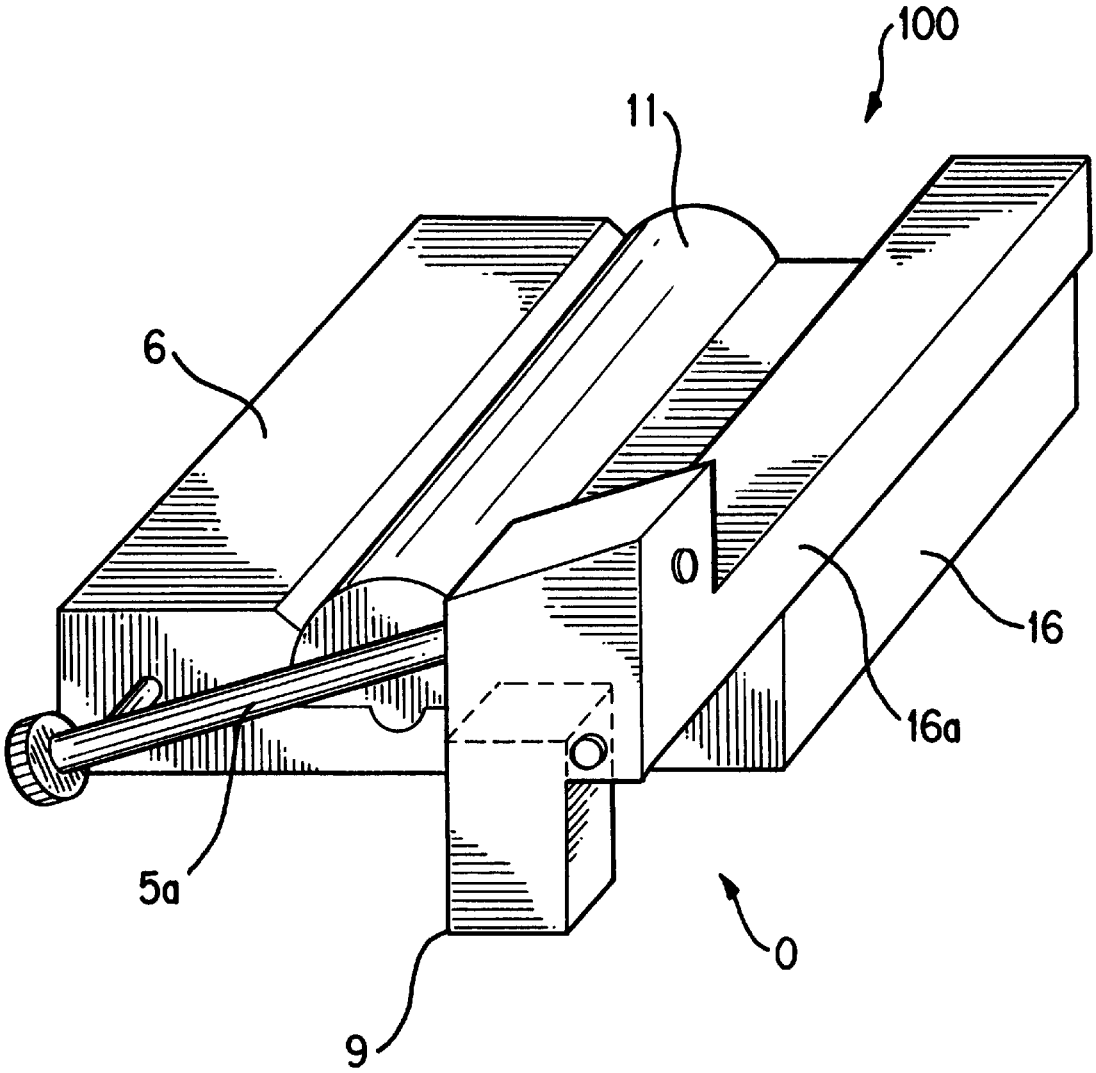
FIG. 21 is a schematic perspective drawing illustrating an exemplary construction of the toner sorting device according to the present invention, wherein the toner sorting device is integrally incorporated in a process cartridge for an image forming apparatus.

FIG. 21 is a schematic perspective drawing showing an exemplary construction of a toner sorting device according to the present invention, which is integrally incorporated in a process cartridge in which image forming parts for an image forming apparatus are integrated. As shown in FIG. 21, a photoconductor cleaning unit 6, a photoconductor 11 and a developing unit 16 including a toner hopper 16*a* are integrally constructed to form a process cartridge 100. A toner sorting device 0 according to the present invention including a discardable toner bottle 9 is integrated with the toner hopper 16*a* of the developing unit 16.

Residual used toner collected by the photoconductor cleaning unit 6 is conveyed to a front side of the image forming apparatus and is then conveyed into the toner sorting device 0 via a toner conveying path 5*a*. Reusable toner collected by the reusable toner collecting device 1*b* of FIG. 20 of the toner sorting device 0 is then conveyed into the toner hopper 16*a* via the reusable toner conveying path 5*c* of FIG. 20 connecting to the toner hopper 16*a*.

Figure 22:
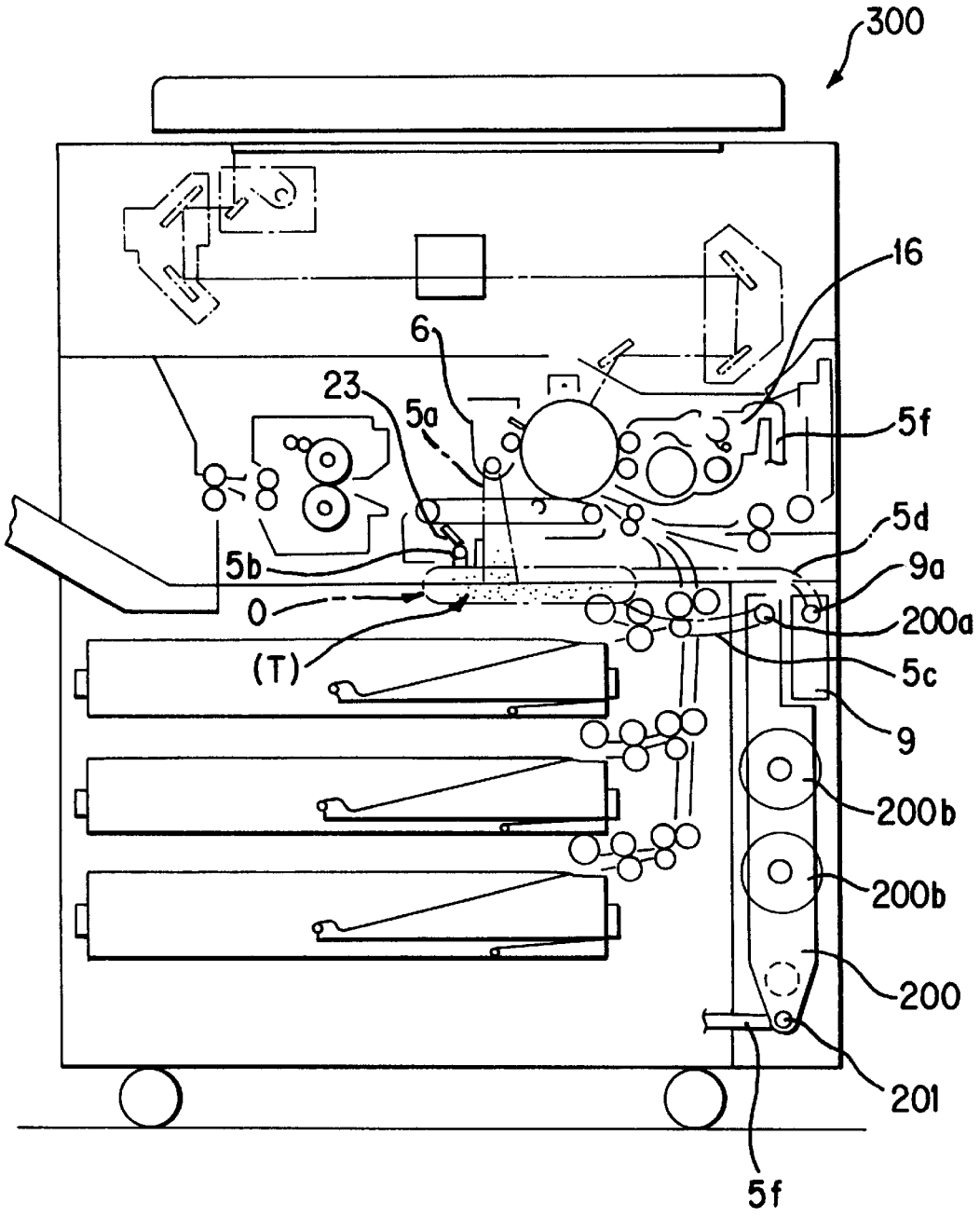
FIG. 22 is a schematic drawing illustrating an alternative exemplary construction of the image forming apparatus according to the present invention, in which a toner bank for supplying toner to a developing unit is provided and reusable toner collected by the toner sorting device according to the present invention is conveyed to the toner bank from the toner sorting device.

FIG. 22 is a schematic drawing illustrating another exemplary construction of an image forming apparatus according to the present invention, in which a toner bank for supplying toner to the developing unit is provided and reusable toner collected by the toner sorting device according to the present invention is conveyed to the toner bank from the toner sorting device.

In FIG. 22, reusable toner separated from used toner by a toner sorting device 0 is conveyed to a toner bank 200 via a toner conveying path 5*c* and is moved into the toner bank 200 through an inlet 200*a*. The remaining toner discharged from the sorting device 0 is conveyed to a discardable toner bottle 9 via a remaining toner conveying path 5*d* and is put into the discardable toner bottle 9 through the inlet 9*a*.

The reusable toner is mixed with unused toner supplied from toner bottles 200*b* laterally disposed in the toner bank 200 to be conveyed to a developing unit 16. The developing unit 16 is connected to the toner bank 200 by a toner supply path 5*f*, composed of, for example, a flexible pipe made of a flexible material which will not be affected by toner, such as nylon or TEFLON (trademark). Mixed toner is then conveyed to the developing unit 16 by, for example, a powder pump unit 201 placed near the toner bank 200 and connected to the toner bank 200.

Figure 23:
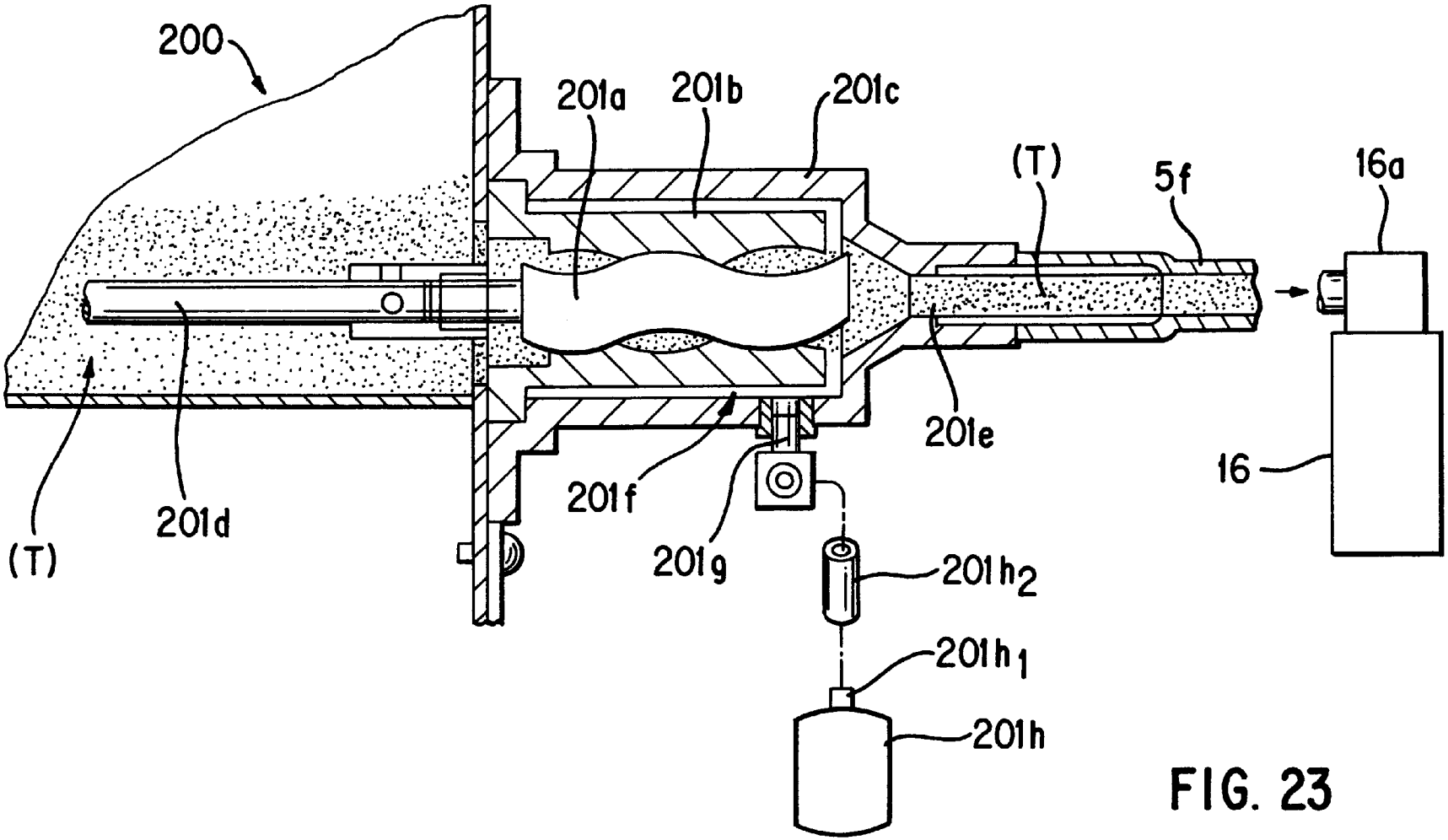
FIG. 23 is a sectional drawing showing an exemplary construction of a powder pump unit used for conveying the reusable toner to the developing unit from the toner bank in the image forming apparatus shown in FIG. 22.

FIG. 23 is a sectional drawing illustrating an exemplary construction of the powder pump unit 201 of FIG. 22 which is used for conveying toner to the developing unit 16 from the toner bank 200. The powder pump unit 201 is disposed in the toner supplying path 5*f* (FIG. 22) which extends from a lower part of the toner bank 200 to connect to the developing unit 16. The powder pump unit 200 includes a screw-type pump, referred to as a Moineau-pump, which is constructed of a rotor 201*a*, a stator 201*b* and a holder 201*c*. The rotor 201*a* is engaged with a driving source such as a motor (not shown) via a driving shaft 201*d*, as shown in FIG. 23, or a lateral conveying screw in which a screw is provided on the outer circumferential surface of its axis. The rotor 201*a* is rotated by rotation of the driving source. The rotor 201*a* is enclosed by the stator 201*b* which is made of an elastic material such as rubber. The stator 201*b* is held by the holder 201*c*. Toner conveyed from the toner bank 200 is fed into the pump unit 201 of FIG. 22 from the side of the driving shaft 201*d* and the toner is conveyed towards a toner exit path 201*e* by rotation of the rotor 201*a*. A gap 201*f* of about 1 mm is formed between the outer circumferential surface of the stator 201*b* and the internal circumferential surface of the holder 201*c*. The gap 201*f* connects to the toner exit path 201*e*. An air supplying inlet 201*g* is provided to supply air through the gap 201*f* into the toner exit path 201*e*. The air supplying inlet 201*g* connects to an air outlet $\mathbf{201}h_1$ of an air pump 201*h* through an air supplying pipe $\mathbf{201}h_2$. When the air pump 201*h* is activated, about 0.5 to 1 liter per minute of air is pumped into the toner exit path 201*e* through the air supplying pipe $\mathbf{201}h_2$ and the air supplying inlet 201*g*. Fluidity of the toner in the toner exit path 201*e* is enhanced and the toner mixed with air is moved to the toner supplying path 5*f* to be conveyed to the toner hopper 16*a* of the developing unit 16.

Each of the toner sorting devices according to the present invention described heretofore can be operated during an image forming operation of an image forming apparatus in which the device is used. The toner sorting devices may be also operated for a predetermined period of time after the image forming operation is terminated, so that reusable toner remaining inside the sieve 2*a* is substantially separated from the used toner or the toner clogging meshes of the sieve 2*a* is substantially removed.

Obviously, numerous additional modifications and variations of the present invention are possible in light of the above teachings. It is therefore to be understood that within the scope of the appended claims, the present invention may be practiced other than as specifically described herein.

This application is based upon Japanese patent applications No. 09-004643, No. 09-100458, and No. 09-101984 respectively filed in the Japanese Patent Office on Jan. 14, 1997, Apr. 17, 1997, and Apr. 18, 1997 and the entire contents of each application is hereby incorporated by reference.

What is claimed as new and desired to be secured by Letters Patent of the United States is:

1. A toner sorting device, comprising:

intake means for taking in used toner conveyed from an image forming apparatus and conveying the used toner in a predetermined direction;

at least one sifting means for sifting the used toner conveyed from the intake means to separate reusable toner from the used toner, the at least one sifting means including a tubular sieve and having a first opening for receiving the used toner conveyed from the intake means to be moved into the sifting means and a second opening for discharging remaining toner separated from the reusable toner and remaining inside the sifting means;

reusable toner collecting means for collecting the reusable toner separated from the used toner by the sifting means; and remaining toner collecting means for collecting the remaining toner discharged from the sifting means.

2. A toner sorting device, comprising:

intake means for taking in used toner conveyed from an image forming apparatus and conveying the used toner in a predetermined direction;

at least one sifting means for sifting the used toner conveyed from the intake means to separate reusable toner from the used toner, the at least one sifting means being tubular and having a first opening for receiving the used toner conveyed from the intake means to be moved into the sifting means and a second opening for discharging remaining toner separated from the reusable toner and remaining inside the sifting means, the at least one sifting means including a plurality of sifting means disposed in series in the predetermined direction in which the used toner taken in by the intake means is conveyed by the intake means;

reusable toner collecting means for collecting the reusable toner separated from the used toner by the sifting means; and remaining toner collecting means for collecting the remaining toner discharged from the sifting means.

3. A toner sorting device, comprising:

intake means for taking in used toner conveyed from an image forming apparatus and conveying the used toner in a predetermined direction;

at least one sifting means for sifting the used toner conveyed from the intake means to separate reusable toner from the used toner, the at least one sifting means being tubular and having a first opening for receiving the used toner conveyed from the intake means to be moved into the sifting means and a second opening for discharging remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and sifting accelerating means for accelerating sifting of the used toner by the at least one sifting means.

4. The toner sorting device according to claim 1, wherein the intake means includes a plurality of inlets for taking in the used toner.

5. The toner sorting device according to claim 1, wherein the sifting means further includes holding means for holding the sieve so that the sieve is rotatable, and wherein the sieve has a first opening for receiving the used toner conveyed from the intake means to be moved into the sieve at a first plane on a first edge of the sieve and a second opening for discharging the remaining toner separated from the reusable toner and remaining inside the sieve at a second plane on a second edge of the sieve.

6. The toner sorting device according to claim 5, wherein the sieve is held by the holding means at one end.

7. The toner sorting device according to claim 5, wherein the sieve has a circular cross section.

8. The toner sorting device according to claim 5, wherein the sieve has a polygonal cross section.

9. The toner sorting device according to claim 5, wherein the sieve includes a rib.

10. The toner sorting device according to claim 5, wherein the sieve includes a tubular net.

11. The toner sorting device according to claim 5, wherein the sieve is made of resin.

12. The toner sorting device according to claim 5, wherein the sieve is made of metal.

13. The toner sorting device according to claim 5, wherein the sieve and the holding means are molded in one piece.

14. The toner sorting device according to claim 5, wherein the sifting means includes means for preventing clogging of a plurality of meshes of the sieve by toner.

15. The toner sorting device according to claim 14, wherein the means for preventing clogging is disposed on the interior of the sieve.

16. The toner sorting device according to claim 14, wherein the means for preventing clogging is disposed on the exterior of the sieve.

17. The toner sorting device according to claim 14, wherein the means for preventing clogging includes a flexible member.

18. The toner sorting device according to claim 17, wherein the flexible member has a brush shape.

19. The toner sorting device according to claim 17, wherein the flexible member comprises a film piece.

20. The toner sorting device according to claim 3, wherein the sifting means includes a tubular sieve for separating the reusable toner from the used toner, and the sifting accelerating means includes a toner thrusting member for thrusting the used toner conveyed from the intake means against an internal circumferential surface of the sieve to move reusable toner through a plurality of meshes of the sieve to be separated from the used toner.

21. The toner sorting device according to claim 20, wherein the intake means includes a pipe-shaped part through which the used toner taken in through the intake means is conveyed in the predetermined direction and which engages with the sieve at an end of the pipe-shaped part in the direction in which the used toner is conveyed, the end of the pipe-shaped part being disposed inside the sieve, the toner thrusting member being fixed to the end of the pipe-shaped part.

22. The toner sorting device according to claim 20, wherein the toner thrusting member is flexible.

23. The toner sorting device according to claim 22, wherein the toner thrusting member has a brush shape.

24. The toner sorting device according to claim 22, wherein the toner thrusting member comprises a film piece.

25. The toner sorting device according to claim 3, wherein the sifting means includes a tubular sieve for separating the reusable toner from the used toner, and the sifting accelerating means includes means for shaking off toner from internal and external circumferential surfaces and from a plurality of meshes of the sieve.

26. The toner sorting device according to claim 25, wherein the means for shaking off toner includes vibrating means for vibrating the sieve.

27. The toner sorting device according to claim 26, wherein the vibrating means includes a protrusion formed on an outer circumferential surface of the sieve and a vibration applying member pressed in a direction to be thrust against the outer circumferential surface of the sieve which includes the protrusion.

28. The toner sorting device according to claim 26, wherein the sifting means further includes holding means for holding the sieve, and the vibrating means includes a protrusion formed on an outer circumferential surface of the holding means and a vibration applying member pressed in a direction to be thrust against the outer circumferential surface of the holding means which includes the protrusion.

29. The toner sorting device according to claim 28, wherein the vibration applying member includes an elastic member for pressing the vibration applying member in the direction to be thrust against the outer circumferential surface of the holding means which includes the protrusion.

30. The toner sorting device according to claim 3, wherein the sifting means includes a tubular sieve for separating the reusable toner from the used toner, and the sifting accelerating means includes a mobile member, inside the sieve, movably held relative to an inner circumferential surface of the sieve.

31. The toner sorting device according to claim 30, wherein the inner surface of the sieve includes a protrusion.

32. The toner sorting device according to claim 30, wherein the mobile member is a column.

33. The toner sorting device according to claim 30, wherein the mobile member is a square pillar.

34. The toner sorting device according to claim 30, wherein the mobile member has a specific gravity which is heavier than a specific gravity of the used toner.

35. The toner sorting device according to claim 30, wherein the mobile member is metal.

36. The toner sorting device according to claim 30, wherein the mobile member is non-magnetic.

37. The toner sorting device according to claim 30, wherein the sieve includes a guide member for guiding the mobile member.

38. The toner sorting device according to claim 30, wherein the sieve includes a concave portion for carrying the used toner moved into the sieve.

39. The toner sorting device according to claim 1, wherein the sifting means includes at least a concentrically overlapped inner mesh and outer mesh tubular sieve for separating reusable toner from the used toner and means for holding the inner mesh and outer mesh sieves so that the sieves are rotatable.

40. The toner sorting device according to claim 39, wherein the outer mesh tubular sieve is finer than the inner mesh tubular sieve.

41. The toner sorting device according to claim 1, further comprising remaining toner discharging means for discharging from the toner sorting device the remaining toner collected by the remaining toner collecting means at a predetermined timing.

42. A toner sorting device, comprising:

intake means for taking in used toner conveyed from an image forming apparatus and conveying the used toner in a predetermined direction;

at least one sifting means for sifting the used toner conveyed from the intake means to separate reusable toner from the used toner, the at least one sifting means being tubular and having a first opening for receiving the used toner conveyed from the intake means to be moved into the sifting means and a second opening for discharging remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and remaining toner discharging means for discharging from the toner sorting device the remaining toner collected by the remaining toner collecting means at a predetermined timing, the remaining toner discharging means including the second opening for discharging the remaining toner and a lid for closing or opening the second opening.

43. A toner sorting device, comprising:

intake means for taking in used toner conveyed from an image forming apparatus and conveying the used toner in a predetermined direction;

at least one sifting means for sifting the used toner conveyed from the intake means to separate reusable toner from the used toner, the at least one sifting means being tubular and having a first opening for receiving the used toner conveyed from the intake means to be moved into the sifting means and a second opening for discharging remaining toner separated from the reusable toner and remaining inside the sifting means, the at least one sifting means including a lid for closing the second opening for discharging the remaining toner, the lid being movable to a first position for closing the second opening or to a second position for opening the second opening;

reusable toner collecting means for collecting the reusable toner separated from the used toner by the sifting means; and remaining toner collecting means for collecting the remaining toner discharged from the sifting means.

44. A toner sorting device, comprising:

intake means for taking in used toner conveyed from an image forming apparatus and conveying the used toner in a predetermined direction;

at least one sifting means for sifting the used toner conveyed from the intake means to separate reusable toner from the used toner, the at least one sifting means being tubular and having a first opening for receiving the used toner conveyed from the intake means to be moved into the sifting means and a second opening for discharging remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the remaining toner collected by the remaining toner collecting means upstream of the sifting means in the predetermined direction in which the used toner is conveyed.

45. The toner sorting device according to claim 44, further comprising means for discharging the remaining toner from the remaining toner conveying path at a predetermined timing.

46. The toner sorting device according to claim 1, further comprising means for conveying the reusable toner collected by the reusable toner collecting means to an image forming device of the image forming apparatus.

47. The toner sorting device according to claim 1, further comprising means for conveying the reusable toner collected by the reusable toner collecting means to a toner supplying device of the image forming apparatus.

48. The toner sorting device according to claim 1, further comprising means for conveying the reusable toner collected by the reusable toner collecting means to a container.

49. The toner sorting device according to claim 1, wherein the toner sorting device operates during a time period when an image forming operation is being performed by the image forming apparatus.

50. A toner sorting device, comprising:

intake means for taking in used toner conveyed from an image forming apparatus and conveying the used toner in a predetermined direction;

at least one sifting means for sifting the used toner conveyed from the intake means to separate reusable toner from the used toner, the sifting means being tubular and having a first opening for receiving the used toner conveyed from the intake means to be moved into the sifting means and a second opening for discharging remaining toner separated from the reusable toner and remaining inside the sifting means;

reusable toner collecting means for collecting the reusable toner separated from the used toner by the sifting means; and remaining toner collecting means for collecting the remaining toner discharged from the sifting means, wherein the toner sorting device operates during a time period when an image forming operation is being performed by the image forming apparatus, and wherein the toner sorting device operates during a time period other than when an image forming operation is being performed by the image forming apparatus.

51. A process cartridge for an image forming apparatus, comprising:

a photoconductor for forming a latent image thereupon;

a developing device for developing the latent image with toner;

a cleaning device for removing residual used toner from a surface of the photoconductor and collecting the used toner; and a toner sorting device for separating reusable toner from the used toner, the toner sorting device including:

intake means for taking in the used toner collected by the cleaning device and conveying the used toner in one direction, sifting means for sifting the used toner conveyed from the intake means so as to separate reusable toner from the used toner, the sifting means including a tubular sieve and having a first opening for receiving the used toner conveyed from the intake means to be moved into the sifting means and a second opening for discharging the used toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the reusable toner collected by the reusable toner collecting means to the developing device.

52. A process cartridge for an image forming apparatus, comprising:

a photoconductor for forming a latent image thereupon;

a developing device for developing the latent image with toner;

a cleaning device for removing residual used toner from a surface of the photoconductor and collecting the used toner; and a toner sorting device for separating reusable toner from the used toner, the toner sorting device including:

intake means for taking in the used toner collected by the cleaning device and conveying the used toner in one direction, sifting means for sifting the used toner conveyed from the intake means so as to separate reusable toner from the used toner, the sifting means being tubular and having a first opening for receiving the used toner conveyed from the intake means to be moved into the sifting means and a second opening for discharging the used toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the reusable toner collected by the reusable toner collecting means to the developing device, wherein the toner sorting device includes means for accelerating sifting of the used toner by the sifting means.

53. The process cartridge according to claim 51, wherein the intake means includes a plurality of inlets for taking in the used toner.

54. The process cartridge according to claim 51, wherein the sifting means further includes means for holding the sieve so that the sieve is rotatable, and wherein the sieve has a first opening for receiving the used toner conveyed from the intake means to be moved into the sieve at a first plane on a first edge of the sieve and a second opening for discharging the remaining toner separated from the reusable toner and remaining inside the sieve at a second plane on a second edge of the sieve.

55. A process cartridge for an image forming apparatus, comprising:

a photoconductor for forming a latent image thereupon;

a developing device for developing the latent image with toner;

a toner supplying device for supplying toner to the developing device;

a cleaning device for removing residual used toner from a surface of the photoconductor and collecting the used toner; and a toner sorting device for separating reusable toner from the used toner, the toner sorting device including:

intake means for taking in the used toner collected by the cleaning device and conveying the used toner in one direction, sifting means for sifting the used toner conveyed from the intake means so as to separate reusable toner from the used toner, the sifting means including a tubular sieve and having a first opening for receiving the used toner conveyed from the intake means to be moved into the sifting means and a second opening for discharging the remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the reusable toner collected by the reusable toner collecting means to the toner supplying device.

56. A process cartridge for an image forming apparatus, comprising:

a photoconductor for forming a latent image thereupon;

a developing device for developing the latent image with toner;

a toner supplying device for supplying toner to the developing device;

a cleaning device for removing residual used toner from a surface of the photoconductor and collecting the used toner; and a toner sorting device for separating reusable toner from the used toner, the toner sorting device including:

intake means for taking in the used toner collected by the cleaning device and conveying the used toner in one direction, sifting means for sifting the used toner conveyed from the intake means so as to separate reusable toner from the used toner, the sifting means being tubular and having a first opening for receiving the used toner conveyed from the intake means to be moved into the sifting means and a second opening for discharging the remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the reusable toner collected by the reusable toner collecting means to the toner supplying device, wherein the toner sorting device includes means for accelerating sifting of the used toner by the sifting means.

57. The process cartridge according to claim 55, wherein the intake means includes a plurality of inlets for taking in the used toner.

58. The process cartridge according to claim 55, wherein the sifting means further includes means for holding the sieve so that the sieve is rotatable, and wherein the sieve has a first opening for receiving the used toner conveyed from the intake means to be moved into the sieve at a first plane on a first edge of the sieve and a second opening for discharging the remaining toner separated from the reusable toner and remaining inside the sieve at a second plane on a second edge of the sieve.

59. An image forming apparatus, comprising:

a photoconductor for forming a latent image thereupon;

a developing device for developing the latent image with toner to form a toner image;

a transfer device for transferring the toner image to a recording sheet;

a photoconductor cleaning device for removing residual used toner from a surface of the photoconductor and collecting the used toner;

a transfer cleaning device for removing used toner from the transfer device and collecting the used toner; and a toner sorting device for separating reusable toner from the used toner, the toner sorting device including:

intake means for taking in the used toner collected by the photoconductor cleaning device and the transfer cleaning device and conveying the used toner in one direction, sifting means for sifting the used toner conveyed from the intake means to separate reusable toner from the used toner, the sifting means including a tubular sieve and having a first opening for receiving the used toner conveyed from the intake means to be moved into the sifting means and a second opening for discharging the remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the reusable toner collected by the reusable toner collecting means to the developing device.

60. An image forming apparatus, comprising:

a photoconductor for forming a latent image thereupon;

a developing device for developing the latent image with toner to form a toner image;

a transfer device for transferring the toner image to a recording sheet;

a photoconductor cleaning device for removing residual used toner from a surface of the photoconductor and collecting the used toner;

a transfer cleaning device for removing said toner from the transfer device and collecting the used toner; and a toner sorting device for separating reusable toner from the used toner, the toner sorting device including:

intake means for taking in the used toner collected by the photoconductor cleaning device and the transfer cleaning device and conveying the used toner in one direction, sifting means for sifting the used toner conveyed from the intake means to separate reusable toner from the used toner, the sifting means being tubular and having a first opening for receiving the used toner conveyed from the intake means to be moved into the sifting means and a second opening for discharging the remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the reusable toner collected by the reusable toner collecting means to the developing device, wherein the toner sorting device includes means for accelerating sifting of the used toner by the sifting means.

61. The image forming apparatus according to claim 59, wherein the intake means includes a plurality of inlets for taking in the used toner.

62. The image forming apparatus according to claim 59, wherein the sifting means further includes means for holding the sieve so that the sieve is rotatable, and wherein the sieve has a first opening for receiving the used toner conveyed from the intake means to be moved into the sieve at a first plane on a first edge of the sieve and a second opening for discharging the remaining toner separated from the reusable toner and remaining inside the sieve at a second plane on a second edge of the sieve.

63. An image forming apparatus, comprising:

a photoconductor for forming a latent image thereupon;

a developing device for developing the latent image with toner;

a toner supplying device for supplying toner to the developing device;

a cleaning device for removing residual used toner from a surface of the photoconductor and collecting the used toner; and a toner sorting device for separating reusable toner from the used toner, the toner sorting device including:

intake means for taking in the used toner collected by the cleaning device and conveying the used toner in one direction, sifting means for sifting the used toner conveyed from the intake means to separate reusable toner from the used toner, the sifting means including a tubular sieve and having a first opening for receiving the used toner conveyed from the intake means to be moved into the sifting means and a second opening for discharging the remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the reusable toner collected by the reusable toner collecting means to the toner supplying device.

64. An image forming apparatus, comprising:

a photoconductor for forming a latent image thereupon;

a developing device for developing the latent image with toner;

a toner supplying device for supplying toner to the developing device;

a cleaning device for removing residual used toner from a surface of the photoconductor and collecting the used toner; and a toner sorting device for separating reusable toner from the used toner, the toner sorting device including:

intake means for taking in the used toner collected by the cleaning device and conveying the used toner in one direction, sifting means for sifting the used toner conveyed from the intake means to separate reusable toner from the used toner, the sifting means being tubular and having a first opening for receiving the used toner conveyed from the intake means to be moved into the sifting means and a second opening for discharging the remaining toner separated from the reusable toner and remaining inside the sifting means;

reusable toner collecting means for collecting the reusable toner separated from the used toner by the sifting means;

remaining toner collecting means for collecting the remaining toner discharged from the sifting means; and means for conveying the reusable toner collected by the reusable toner collecting means to the toner supplying device, wherein the toner sorting device includes means for accelerating sifting of the used toner by the sifting means.

65. The image forming apparatus according to claim 63, wherein the intake means includes a plurality of inlets for taking in the used toner.

66. The image forming apparatus according to claim 63, wherein the sifting means further includes means for holding the sieve so that the sieve is rotatable, and wherein the sieve has a first opening for receiving the used toner conveyed from the intake means to be moved into the sieve at a first plane on a first edge of the sieve and a second opening for discharging the remaining toner separated from the reusable toner and remaining inside the sieve at a second plane on a second edge of the sieve.

* * * * *